US008398440B2

(12) United States Patent
Dodds et al.

(10) Patent No.: US 8,398,440 B2
(45) Date of Patent: Mar. 19, 2013

(54) ELECTRICAL CONNECTOR HAVING OFFSET MOUNTING TERMINALS

(75) Inventors: John David Dodds, Harrisburg, PA (US); Alan Crighton, Apex, NC (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 13/556,530

(22) Filed: Jul. 24, 2012

(65) Prior Publication Data

US 2012/0289071 A1 Nov. 15, 2012

Related U.S. Application Data

(62) Division of application No. 12/914,147, filed on Oct. 28, 2010, now Pat. No. 8,267,724.

(60) Provisional application No. 61/257,180, filed on Nov. 2, 2009.

(51) Int. Cl.
*H01R 24/00* (2011.01)

(52) U.S. Cl. ..... 439/660; 29/872

(58) Field of Classification Search ..... 439/660, 439/607.08, 607.01, 941, 947, 76.1, 76.2, 439/676; 29/872, 884, 857, 883, 832
See application file for complete search history.

(56) References Cited

U.S. PATENT DOCUMENTS

| | | | | |
|---|---|---|---|---|
| 5,096,436 | A * | 3/1992 | Noschese | 29/876 |
| 5,660,551 | A | 8/1997 | Sakurai | |
| 5,795,191 | A | 8/1998 | Preputnick et al. | |
| 6,071,127 | A | 6/2000 | Acke et al. | |
| 6,227,882 | B1 | 5/2001 | Ortega | |
| 6,241,564 | B1 | 6/2001 | Chen et al. | |
| 6,319,075 | B1 | 11/2001 | Clark et al. | |
| 6,652,318 | B1 | 11/2003 | Winings et al. | |
| 6,716,045 | B2 | 4/2004 | Meredith | |
| 6,863,549 | B2 | 3/2005 | Brunker et al. | |
| 6,969,268 | B2 | 11/2005 | Brunker et al. | |
| 7,001,189 | B1 | 2/2006 | McGowan et al. | |
| 7,182,642 | B2 | 2/2007 | Ngo et al. | |
| 7,473,108 | B2 | 1/2009 | Lappohn | |
| 7,650,695 | B1 * | 1/2010 | Ju | 29/884 |
| 7,823,281 | B2 * | 11/2010 | Caveney et al. | 29/857 |
| 7,837,505 | B2 | 11/2010 | Minich et al. | |
| 8,267,724 | B2 | 9/2012 | Dodds et al. | |
| 8,292,639 | B2 * | 10/2012 | Achammer et al. | 439/76.2 |
| 2008/0032525 | A1 | 2/2008 | Lappohn | |

FOREIGN PATENT DOCUMENTS

| | | |
|---|---|---|
| DE | 4400702 | 7/1995 |
| EP | 0238801 | 9/1987 |
| EP | 0422785 | 4/1991 |
| EP | 0486298 | 5/1992 |
| EP | 0739064 | 10/1996 |
| EP | 0905826 A2 | 3/1999 |
| EP | 0905826 A3 | 1/2001 |

(Continued)

OTHER PUBLICATIONS

U.S. Appl. No. 08/942,084, filed Oct. 1, 1997, Ortega.

(Continued)

*Primary Examiner* — Jean F Duverne
(74) *Attorney, Agent, or Firm* — Woodcock Washburn LLP

(57) ABSTRACT

In accordance with one embodiment, an electrical connector includes a housing that supports a plurality of electrical contacts. Each electrical contact defines a mating end and an opposing mounting end, and a plurality of mounting terminals disposed at the mounting end. The mounting terminals of each contact are arranged in at least one column extending along a longitudinal direction, such that each column is spaced along a lateral direction, and the mounting terminals of adjacent contacts are longitudinally offset.

23 Claims, 17 Drawing Sheets

FOREIGN PATENT DOCUMENTS

| | | | |
|---|---|---|---|
| EP | 1758211 | A2 | 2/2007 |
| EP | 1758211 | A3 | 3/2007 |
| WO | WO 96/34431 | | 10/1996 |
| WO | WO 2011/053903 | | 5/2011 |

OTHER PUBLICATIONS

FCI, "Vert HDR for 10,10 IMLA, 2mm, Airmax VS Cable Recpt, 4 Pair", www.fciconnect.com, accessed Dec. 1, 2010, 3 pages.

European Patent Application No. 19980117592: European Search Report, dated Dec. 5, 2000, 2 pages.

European Patent Application No. 20060021951: European Search Report, dated Jan. 22, 2007, 2 pages.

International Patent Application No. PCT/US2010/054951: International Search Report dated Apr. 27, 2011, 8 pages.

* cited by examiner

ELECTRICAL CONNECTOR HAVING OFFSET MOUNTING TERMINALS

CROSS-REFERENCE TO RELATED APPLICATIONS

This is a divisional application of U.S. patent application Ser. No. 12/914,147, filed Oct. 28, 2010, which in turn claims priority to U.S. Provisional Patent Application Ser. No. 61/257,180, filed Nov. 2, 2009, the disclosure of which is hereby incorporated by reference as if set forth in its entirety herein.

BACKGROUND

Electrical connectors used to transmit data signals and/or electrical power, such as alternating current (AC) power and/or direct current (DC) power, may include a plurality of power contacts and a plurality of signal contacts mounted in an electrically-insulative housing. In a typical application, the connector may be configured to be mounted onto a substrate, such as a printed circuit board, and configured to mate with a complementary electrical component, which can be a power cable or complementary electrical connector, for example. Specifically, each contact within the housing may include one or more header and/or receptacle contacts that mate with opposed receptacle and/or header contacts, respectively, of the complementary electrical component.

A typical contact includes multiple terminals or pins extending from a bottom portion for electrically connecting the contact to a substrate, such as a printed circuit board. In the case of power contacts, high voltage levels traveling through the terminals can produce arcing across the terminals, or leaking or creeping as described in UL Spec 746A, which is hereby incorporated by reference in its entirety. It is known, therefore, that under otherwise constant conditions, for instance substrate material and the number of terminals, spacing the terminals away from each other can reduce the instances of arcing. However, spacing the terminals farther apart while maintaining the number of terminals adds to the overall footprint of the connector, thereby occupying valuable space on the circuit board.

In the case of signal contacts, cross-talk between contacts can erode signal transmission if, for instance, the terminals are spaced too close together. Again, however, spacing the mounting terminals farther apart results in an increase of the connector footprint on the circuit board.

It is therefore desirable to provide an electrical contact having improved electrical properties without increasing the footprint of the connector on the substrate to which the connector is mounted.

SUMMARY

In accordance with one embodiment, an electrical connector includes a connector housing that defines a mating interface and an opposed mounting interface. The electrical connector further includes a first electrical contact supported by the connector housing and a second electrical contact supported by the housing, each of the first and second electrical contacts defining a mating end and an opposed plurality of mounting terminals. The mounting terminals of each of the first and second electrical contacts are arranged in respective first and second longitudinally elongate columns that are laterally adjacent, such that no mounting terminals are disposed laterally between the first and second adjacent columns. The second column of the first electrical contact is disposed laterally adjacent the first column of the second electrical contact such that no mounting terminals are disposed laterally between the second column of the first electrical contact and the first column of the second electrical contact. At least a first mounting terminal of a select one of the first columns is offset in the longitudinal direction with respect all of the mounting terminals of at least one of the second columns.

DETAILED DESCRIPTION

Figure 1B:
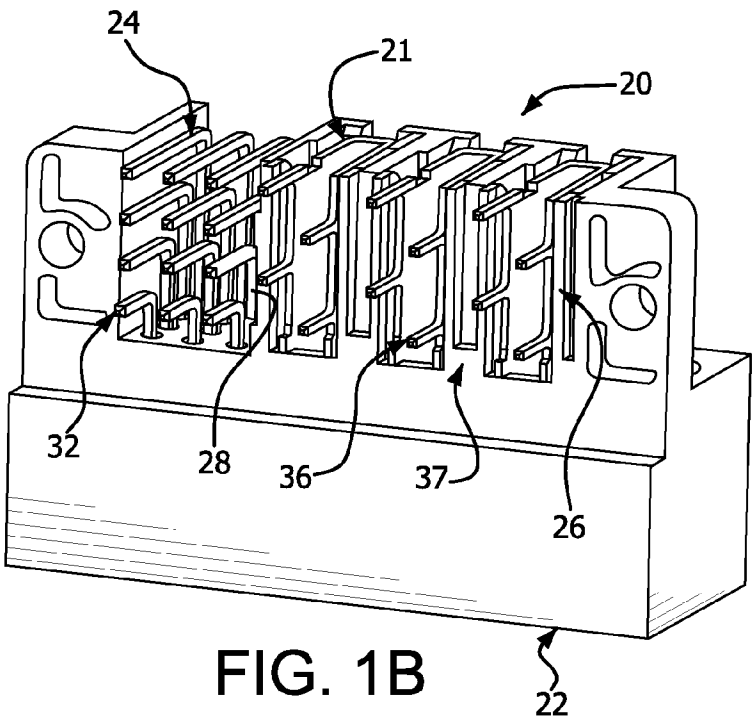
FIG. 1B is a bottom perspective view of the electrical connector illustrated in FIG. 1A.
Figure 1A:
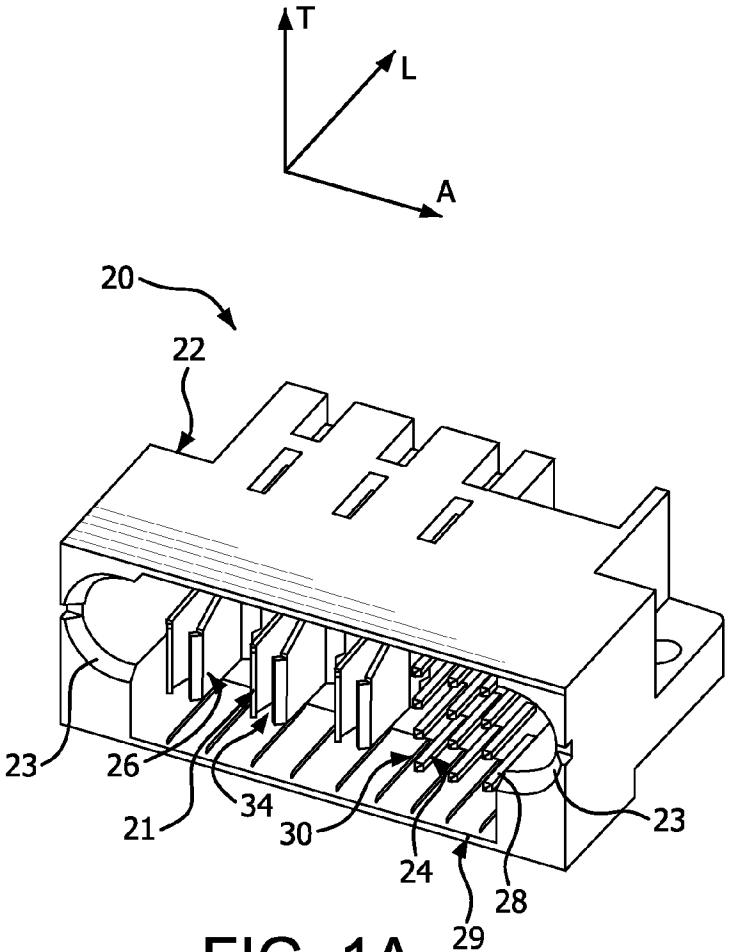
FIG. 1A is a front perspective view of an electrical header connector constructed in accordance with one embodiment.

Referring to FIGS. 1A-2B, an electrical connector 20 includes an insulative dielectric connector housing 22 and a plurality of electrical contacts 21, including signal contacts 24 and power contacts 26, supported by the connector housing 22. The signal contacts 24 provide electrical connectivity for data transmission signals, while the power contacts 26 provide electrical connectivity for power transmission using alternating current (AC) or direct current (DC). In accordance with one embodiment, the power contacts 26 transmit power at any desired AC voltage, such as between and including 400V AC and 480V AC, and at any desired current, such as approximately 7 A. The signal contacts 24 can be identically or substantially identically constructed, and the power contacts 26 can be identically or substantially identically constructed.

Certain terminology may be used in the following description for convenience only and should not be considered as limiting in any way. Fore instance, the connector housing 22 is illustrated as being generally rectangular in shape, and can extend horizontally along a longitudinal direction "L" and lateral direction "A", and vertically along a transverse direction "T". The housing is elongate in the longitudinal direction L. Unless otherwise specified herein, the terms "lateral," "longitudinal," and "transverse" as used to describe the orthogonal directional components of the electrical connector 20 are likewise used to describe the directional components of the remainder of the electrical connector 20. The terms "top," "bottom," "left," "right," "upper," and "lower" designate directions in the figures to which reference is made. Likewise, the terms "inwardly," "outwardly," "upward," and "downward" may designate directions toward and away from, respectively, the geometric center of the referenced object. The terminology includes the words above specifically mentioned, derivatives thereof, and words of similar import.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the electrical components. Accordingly, the terms "vertical" and "horizontal" are used to describe the electrical connector 20 as illustrated merely for the purposes of clarity and convenience, it being appreciated that these orientations may change during use.

The connector housing 22 defines a mating interface 29 and an opposed mounting interface 37. The mating interface 29 is configured to engage a complementary mating interface of an electrical component, such as an electrical connector, that mates with the electrical connector 20. For instance, the connector housing 22 can include any suitable alignment and/or retention features 23 configured to engage corresponding alignment features of the complementary connector. The alignment features 23 are illustrated as recesses formed in the housing 22 that is configured to receive a complementary alignment feature in the form of a post when the electrical connector 20 is mated to the complementary connector. The mounting interface 37 is configured to be mounted onto a substrate, such as a printed circuit board 33 illustrated in FIG. 3. Because the mating interface 29 is oriented substantially perpendicular to the mounting interface 37, the electrical connector 20 can be referred to as a right-angle connector. Alternatively, the electrical connector 20 can be constructed as a "vertical" or "mezzanine" arrangement whereby the mating interface 29 is oriented substantially parallel to the mounting interface 37.

The signal contacts 24 can be constructed as pins, each including a body portion 28 that define a mating end 30 at one end, and a mounting terminal 32 opposite the mating end 30. The mating ends 30 are configured to mate with complementary mating ends of electrical contacts of the complementary electrical component that is to be mated with the electrical connector 20.

The mounting terminals 32 extend down from the housing 22, and are configured to connect to the printed circuit board 33. In one embodiment, the mounting terminals 32 are inserted through complementary plated through-holes 35 that extend through the printed circuit board 33. Alternatively, the mounting terminals 32 can be surface-mounted to the printed circuit board 33 as desired. The mounting terminals 32 can further be soldered to the printed circuit board 33 as desired. Thus, the signal contacts 24 can place the printed circuit board 33 in electrical communication with the complementary electrical connector that is mated to the electrical connector 20. The signal contacts 24 are configured to transmit signal data between the printed circuit board 33 and the complementary electrical connector. As illustrated, the mating ends 30 extend in a direction substantially perpendicular to the mounting terminals 32, such that the signal contacts 26 can be referred to as right-angle electrical contacts. Alternatively, the signal contacts 24 can be constructed as a "vertical" or "mezzanine" arrangement whereby the mating end 30 extends in a direction parallel to the mounting terminals 32.

Likewise, the power contacts 26 each define a mating end 34 at one end, and an opposing mounting terminal 36 at the other end. The mating ends 34 are configured to mate with complementary mating ends of the electrical connector that is to be mated with the electrical connector 20. The mounting terminals 36 are configured to connect to the printed circuit board 33. In one embodiment, the mounting terminals 36 are inserted through plated through-holes 63 of the printed circuit board 33. The through-holes 63 can define mounting locations 66 that define a footprint constructed as described with respect to the footprint 68 described below with respect to FIG. 3B. Alternatively, the mounting terminals 36 can be surface-mounted to the printed circuit board 33. The mounting terminals 26 can further be soldered to the printed circuit board 33 as desired. Thus, the power contacts 26 can place the printed circuit board 33 in electrical communication with the complementary electrical connector that is mated to the electrical connector 20. The power contacts 26 are configured to electrical power between the printed circuit board 33 and the complementary electrical component or connector. As illustrated, the mating ends 34 extend in a direction substantially perpendicular to the mounting ends 36 such that the power contacts 26 can be referred to as right-angle contacts. Alternatively, the power contacts 26 can be constructed as a "vertical" or "mezzanine" arrangement whereby the mating ends 34 extend in a direction parallel to the mounting ends 36.

Because the mating ends 30 and 34 of the signal contacts 24 and power contacts 26, respectively are configured to be received by their complementary contacts, they are referred to as "plug" or "header" contacts, and the electrical connector 20 can be referred to as a "plug" or "header" connector.

Figure 2A:
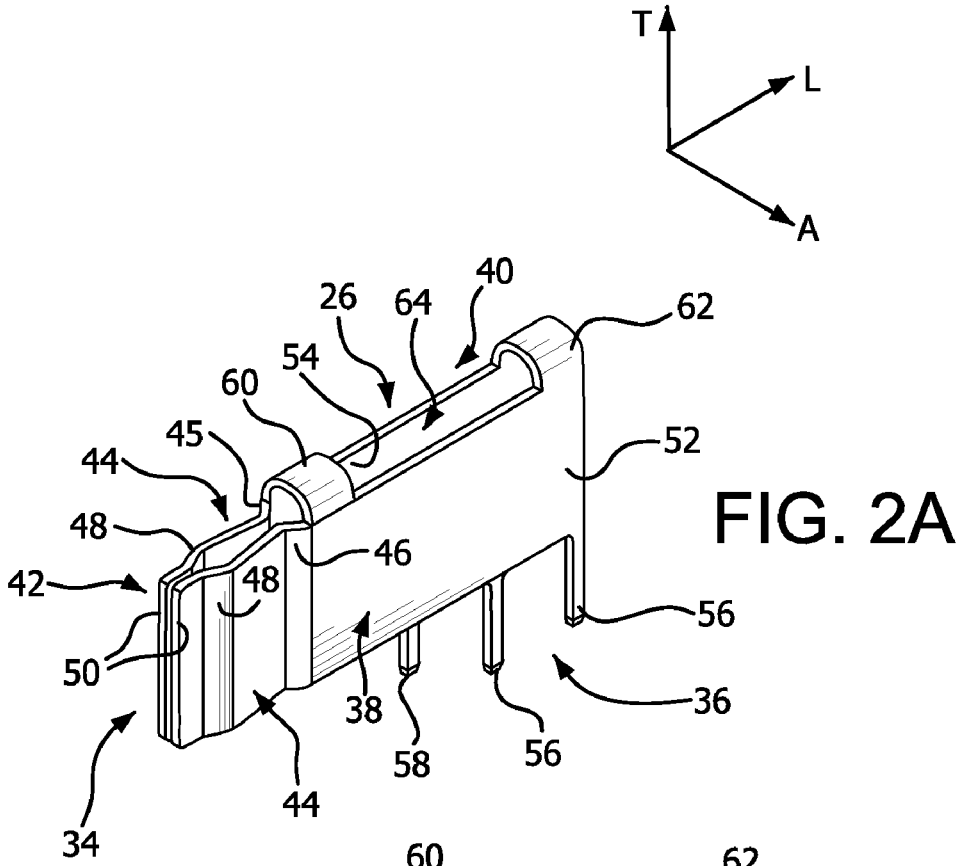
FIG. 2A is a perspective view of one of the power contacts of the electrical connector illustrated in FIGS. 1A-B.
Figure 2B:
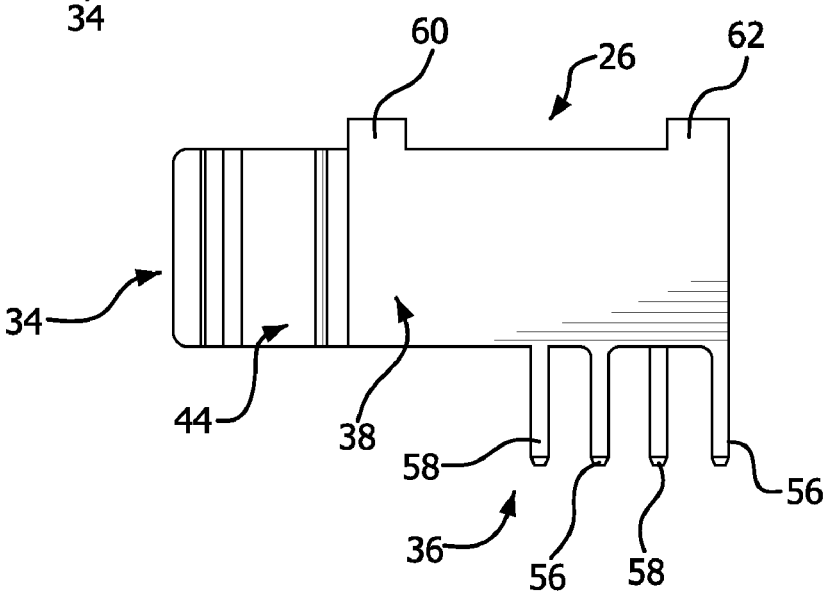
FIG. 2B is a side elevation view of the power contact illustrated in FIG. 2A.

As shown in FIGS. 2A-B, each of the power contacts 26 includes a pair of opposed major side walls 38 and 40. A front projection, identified generally by numeral 42 includes a pair of opposed cantilever beams 44, each beam having inwardly converging proximal section 46, arcuate contact section 48 and a distal section 50. The opposed distal sections 50 are preferably parallel to each other. The distal sections 50 can be positioned slightly apart when the beams are in relaxed condition, but can be flexible and brought together when the beams are deflected as the front projection is inserted into a complementary receptacle contact, thereby providing overstress protection for the beams during mating. While each of the cantilever beams 44 is continuous vertically from its upper end to its lower end, it should be appreciated that the beams 44 may alternatively be split into an upper section that is separated from a lower section, as described in U.S. Pat. No. 6,319,075, the disclosure of which is hereby incorporated by reference as if set forth in its entirety herein.

The side walls 38 and 40 also include first and second substantially planar panels 52 and 54 that extend rearward from the beams 44. The mounting terminal 36 of each power contact 26 includes a first at least one mounting terminal 56 (a pair of terminals 56 as illustrated) that extends down from an edge of the panel 52, and a second at least one mounting terminal 58 (a pair of terminals 58 as illustrated) that extends down from an edge of the panel 54. As will be described in more detail below, at least a select one of the mounting terminals 56 of a select column is longitudinally offset with respect to all mounting terminals 58 of the adjacent column. Thus, the adjacent column is devoid of mounting terminals that are laterally aligned with the select mounting terminal. The mounting terminals 56 and 58 can define through-hole, solder-to-board pins (as shown), press fit pins or surface mount tails, or any suitable alternative structure configured to electrically connect to the printed circuit board 33. The panels 52 and 54 are connected by upper arcuate bridging elements 60 and 62. A medial space 64, adapted for air flow, is defined between the panels 52 and 54. The contact 26 is stamped or otherwise formed as a single piece from a strip of suitable contact materials such as phosphor bronze alloys, beryllium copper alloys, or any suitable alternative electrically conductive material.

Figure 3A:
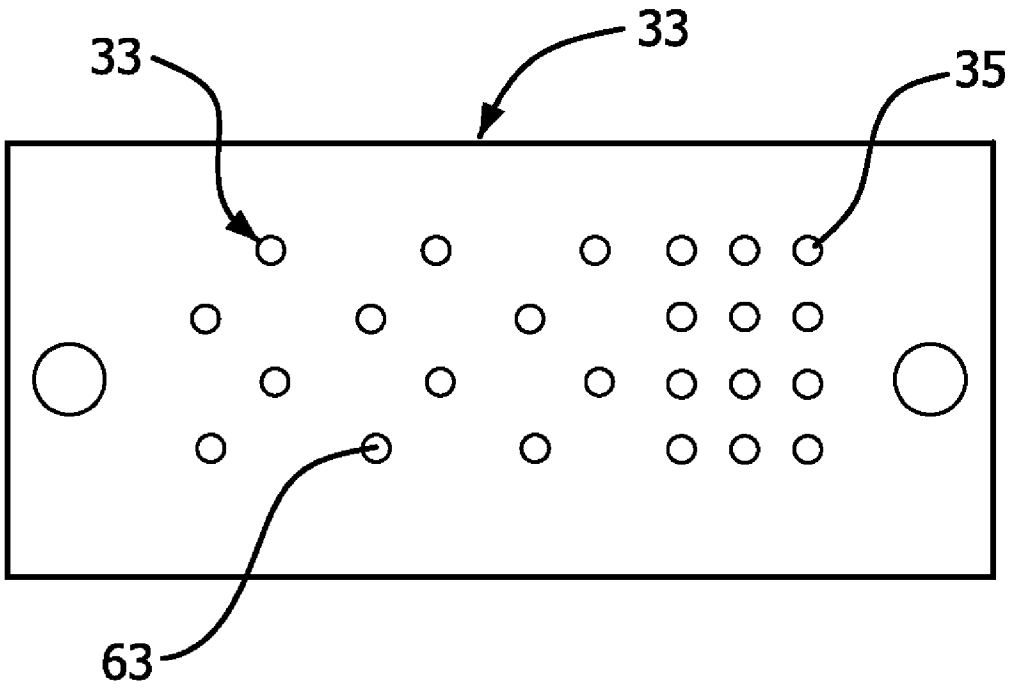
FIG. 3A is a schematic top plan view of a footprint of a printed circuit board onto which the contacts of the connector illustrated in FIGS. 1A-B are configured to be mounted.

FIG. 3A illustrates the printed circuit board 33 as including a plurality of mounting locations 66, which can be provided as plated through holes 66 and 35 configured to receive the mounting terminals 32 and 36 of the signal contacts 24 and power contacts 26 as described above. The mounting terminals can define any geometrical cross-sectional shape as desired.

Figure 3B:
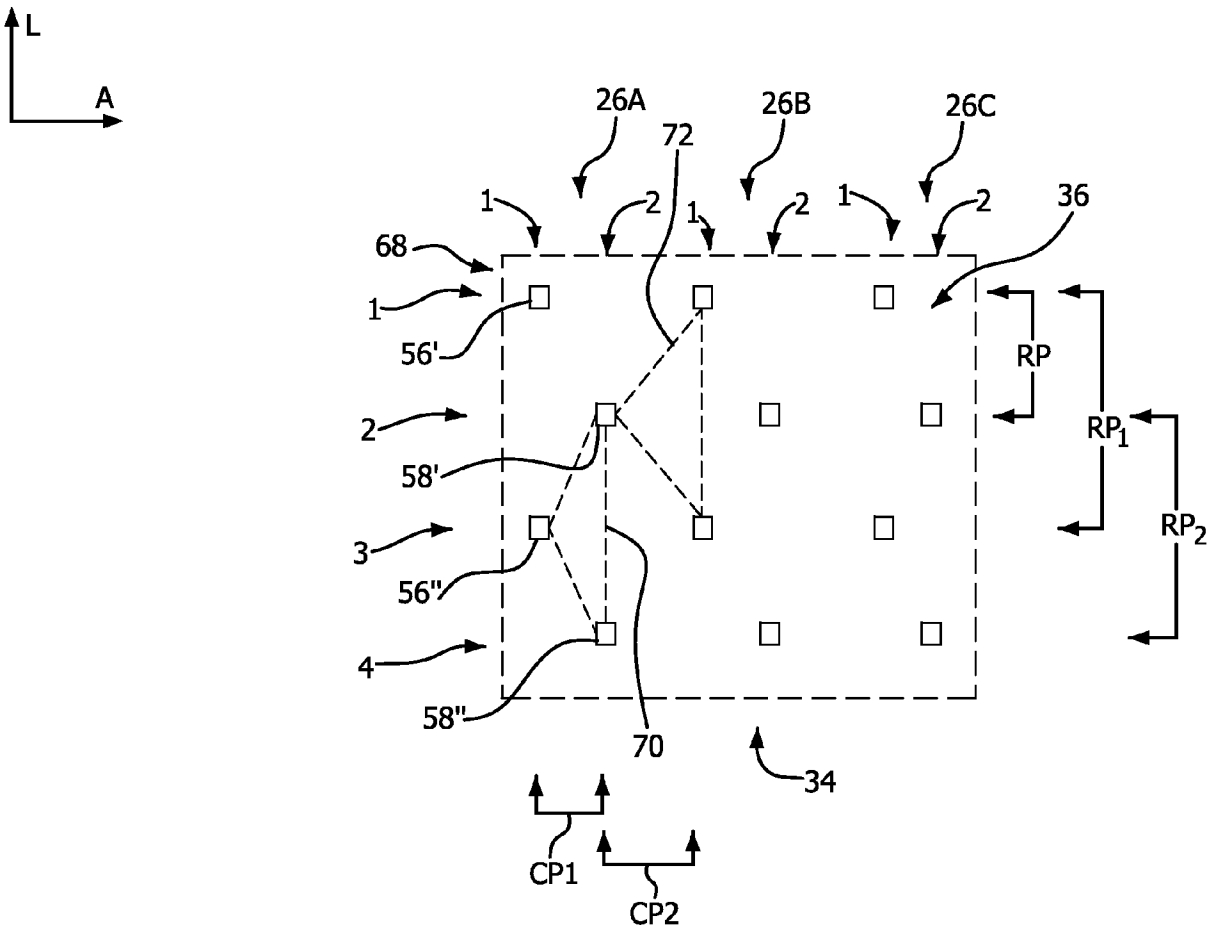
FIG. 3B is schematic top plan view of the power terminal footprint of the connector illustrated in FIGS. 1A-B.
Figure 4B:
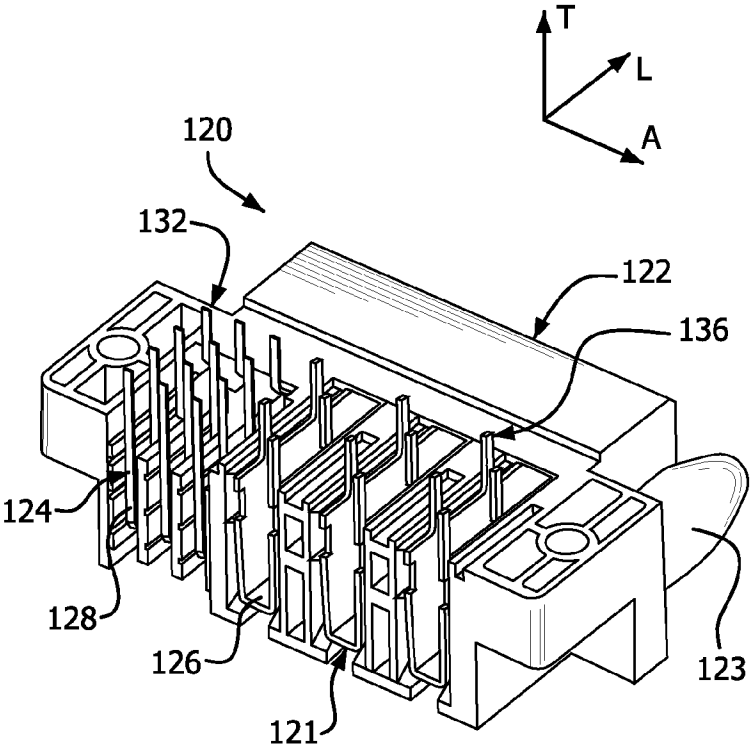
FIG. 4B is a bottom perspective view of the electrical receptacle connector illustrated in FIG. 4A.
Figure 4A:
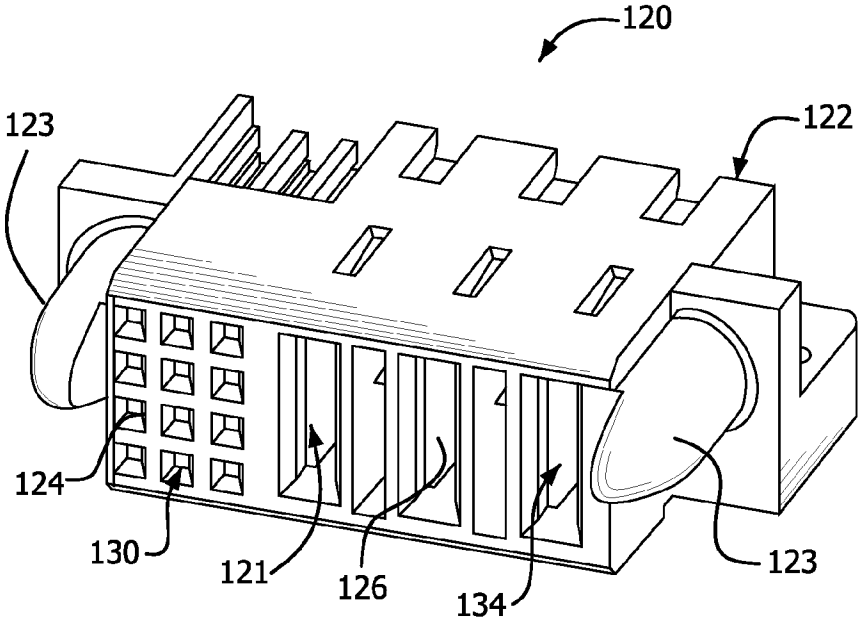
FIG. 4A is a front perspective view of an electrical receptacle connector configured to mate with the electrical header connector illustrated in FIGS. 1A-B.

Referring now to FIG. 3B, the mounting terminals 36 of the power contacts 26 defines a footprint 68 taken from a bottom plan view of the electrical connector 20. The electrical connector 20 is illustrated as including three power contacts 26A-C, though any number of power contacts 26 can be provided as desired. Furthermore, while the footprint 68 is illustrated with respect to the power contacts 26, it should be appreciated that the footprint can likewise be defined by the mounting terminals 32 of the signal contacts 24. The mounting terminals 56 and 58 of the power contacts 26 are arranged in a plurality of columns. For instance, the first mounting terminals 56 of each power contact 26 are arranged in a first column 1 of the respective contact, and the second mounting terminals 58 of each power contact 26 are arranged in a second column 2 of the respective contact 26. Columns 1 and 2 of each power contact 26 are disposed laterally adjacent each other and extend along a direction that is substantially parallel to each other. The power contacts 26 are further arranged such that the first column 1 of one power contact 26 is disposed laterally adjacent to the second column 2 of its adjacent power contact 26.

The spacing between the centerlines of adjacent columns 1 and 2 may be referred to as the column pitch CP. The column pitch CP1 between columns 1 and 2 of a given power contact 26 is illustrated as being less than the column pitch CP2 between columns 2 and 1 of adjacent power contacts 26. In the illustrated embodiment, the column pitch CP1 can be between 1 and 4 mm, such as between 2 and 3 mm, such as between 2.25 and 2.75 mm, for instance approximately 2.5 mm or more particularly 2.54 mm. The column pitch CP2 can be between 1 and 6 mm, such as between 2 and 5 mm, such as between 3 and 4 mm, such as between 3.5 and 4 mm, such as approximately 3.8 mm or more particularly 3.81 mm. Thus, the columns 1 and 2 of a given power contact 26 are spaced laterally closer together than the columns of adjacent power contacts 26 such that the column pitch CP2 is greater than the column pitch CP1, as illustrated in FIG. 3B. It should be appreciated, however, that the column pitch CP1 could alternatively be substantially equal to or greater than the column pitch CP2 if desired. It should be further appreciated that any desired column pitch could be used as desired.

One or more, up to all as illustrated, of the first and second terminals 56 and 58 of each power contact 26 are aligned with the respective like terminals 56 and 58 of the other power contacts 26, arranged in rows 1-4. A first or upper terminal 56' of the first terminals 56 is disposed in row 1, a first or upper terminal 58' of the second terminals 58 is disposed in row 2, a second or lower terminal 56" of the first terminals 56 is disposed in row 3, and a second or lower terminal 58" of the second terminals 58 is disposed in row 4. The spacing between the centerlines of adjacent rows may be referred to as the row pitch RP. As illustrated, the row pitch RP1 of the mounting terminals 56' and 56" along column 1 is twice the row pitch RP. The Row pitch RP1 can be equal or substantially equal to the row pitch RP2 of the mounting terminals 58' and 58", though the row pitch RP1 could be greater or less than row pitch RP2 if desired. As illustrated, the row pitch RP between adjacent rows 1-4 can be between 1 and 4 mm, such as between 2 and 3 mm, such as between 2.25 and 2.75 mm, for instance approximately 2.5 mm or more particularly 2.54 mm. Thus, rows 1-4 can be spaced apart the same distance as the columns 1 and 2 of a given contact 26.

Furthermore, the mounting terminals 56 and 58 of a given power contact 26 are longitudinally staggered with respect to each other, such that at least one of the mounting terminals 56 and 58 along the respective column is disposed longitudinally between a pair of the other terminals 56 and 58 of the adjacent column. Otherwise stated, the rows 1 and 3 defined by the terminals of one column of a given power contact 26 are not aligned with the rows 2 and 4 defined by the terminals of the other column of the power contact 26. For example, a select mounting terminal such as the bottom mounting terminal 56" of the power contact 26A is disposed longitudinally between the adjacent terminals 58; and 58". It is further appreciated that no terminals are disposed between the mounting terminals 58' and 58" along column 2. Otherwise stated, column 2 is devoid of mounting terminals that are in lateral alignment with the bottom mounting terminal 56". The bottom terminal 56" can be disposed longitudinally midway between the adjacent terminals 58' and 58", such that the mounting terminals 56" and the mounting terminals 58' and 58" define the vertices of an isosceles triangle 70. The angles defined by the vertices of the triangle 70 can be dependent on the corresponding row pitch, and column pitch CP1. It should be appreciated that while terminals of one column are illustrated as being disposed midway between the terminals of an adjacent column with respect to the longitudinal direction, the terminals can be offset by any distance as desired.

FIGS. 1-3B illustrate that the connector housing 22 supports a first electrical contact 26A and a second electrical contact 26B. Each of the first and second electrical contacts 26A and 26B defines respective mating ends 34 and an opposed plurality of mounting terminals 56 and 58. The mounting terminals 56 and 58 of each of the first and second electrical contacts 26A and 26B are arranged in respective first and second longitudinally elongate columns 1 and 2 that are laterally adjacent, such that no mounting terminals are disposed laterally between the first and second adjacent columns 1 and 2. The second column 2 of the first electrical contact 26A is disposed laterally adjacent the first column 1 of the second electrical contact 26B such that no mounting terminals are disposed laterally between the second column 2 of the first electrical contact 26A and the first column 1 of the second electrical contact 26B. At least a first mounting terminal (such as mounting terminal 56") of a select one of the first columns 1 (for instance, column 1 of the first electrical contact 26A) is offset in the longitudinal direction with respect to at least a second mounting terminal (such as mounting terminal 58); of one of the second columns 2 (for instance, column 2 of the first electrical contact 26B). Furthermore, the first mounting terminal 56" of the first column 1 of the first electrical contact 26A is offset in the longitudinal direction with respect to all mounting terminals 58 of the second column 2 of the first electrical contact 26B. It should be appreciated that the select one of the first columns 1 can be the column 1 of the first electrical contact 26A or the first column 1 of the second electrical contact 26B, and the select one of the second columns 2 can be the column 2 of the first electrical contact 26A or the second column 2 of the second electrical contact 26B.

With continuing reference to FIG. 3B, each column 1 and 2 of a given power contact 26 includes a terminal 56 or 58 that is disposed longitudinally between adjacent terminals 58 or 56, respectively, disposed along an immediately adjacent column of an immediately adjacent power contact 26. In accordance with the illustrated embodiment, immediately adjacent power contacts 26 are arranged such that no power contacts are disposed between the immediately adjacent power contacts. For instance, the upper terminal 58' of column 2 of power contact 26A is disposed longitudinally between the mounting terminals 56' and 56" of column 1 of the immediately adjacent contact 26B. It should be appreciated that no terminals are disposed between rows 1 and 3 along column 1 of contact 26B. The upper terminal 58' of the power contact 26A is illustrated as disposed longitudinally midway between the adjacent terminals 56' and 56" of the immediately adjacent contact 26B, such that the mounting terminals 58', 56' and 56" define an isosceles triangle 72. The angles defined by the vertices of the triangle 72 can be dependent on the row pitch RP of the terminals and also on the column pitch CP2. Because the column pitch CP2 is greater than the column pitch CP1, the angles defined at the base of triangle 72 are greater than the angles defined at the base of triangle 70. It should be appreciated that while terminals of one column are illustrated as being disposed longitudinally midway between the terminals of an adjacent column of the adjacent connector, the terminals can be offset by any longitudinal distance as desired.

Thus, the mounting terminals 56 and 58 of adjacent columns 1 and 2 of a given power contact 26 are spaced apart a greater distance than if they were not longitudinally offset (e.g., than if they were in lateral alignment). Thus, it can be said that a select pair of mounting terminals disposed in adjacent columns are spaced apart a distance greater than the lateral distance between the adjacent columns. Specifically, conventional connectors have been constructed substantially as illustrated with respect to the electrical connector 20, however the mounting terminals are not longitudinally offset in the manner described above. Therefore, the present connector 20 provides increased spacing between the mounting terminals without increasing the footprint of the mounting end of the connector with respect to the similarly constructed connector. Otherwise stated, a conventional connector can be modified by offsetting the mounting terminals along every other column to increase the distance between adjacent terminals without increasing the footprint of the mounting end of the connector.

It should further be appreciated that the increased spacing between the mounting terminals 56 and 58 allows the power contacts 26 to carry an increased working voltage (for instance 400V or greater) with respect to conventional terminals, while at the same time reducing or preventing arcing across the mounting terminals 56 and 58 during operation. The power contacts 26 can further carry greater current than other single-beam contacts.

While the power contacts 26A-C are illustrated as having columns of offset terminals 56 and 58 as described above, it should be appreciated that the power contacts 26A-C can be constructed from a substantially identical connector including four aligned terminals in each column 1 and 2, such that electrical contacts of the first and second columns are longitudinally aligned. Certain select mounting terminals can be removed or otherwise eliminated to arrive at the footprint having longitudinally offset mounting terminals as described above with reference to FIG. 3B. It should further be appreciated that the power contacts 26A-C can include any number of terminals 56 and 58 as desired, which can be produced by removing selected terminals from a preexisting contact having contacts in each column, and in particular by removing selected contacts from one of the columns that are aligned with contacts of the other column. It should further be appreciated that the power contacts 26 are devoid of ground contacts disposed between the power contacts 26.

As described in U.S. Pat. No. 7,182,642, the disclosure of which is hereby incorporated by reference as if set forth in its entirety herein, current generally follows a path of least resistance along the power contacts 26 to the terminals 36 and then into the printed circuit board 33. Accordingly, in conventional connectors, increased numbers of terminals generally allow for higher levels of current to flow through the contact. Unfortunately, increased numbers of terminals decreases the spacing between terminals, which limits the working voltage. The power contacts 26 are arranged with dual side walls 38 and 40, thereby dividing current evenly through the mounting terminals 56 and 58. The power contacts 26 thus provide better, or more uniform, current distribution than conventional single-beam contacts.

Accordingly, the electrical connector 20 includes power contacts 26 that are configured to increase the space between adjacent terminals 36 of a given power contact 26 and/or between two immediately adjacent power contacts 26, thereby increasing the working voltage between the mounting and mating ends while avoiding arcing, without otherwise increasing the overall footprint at the mounting end 36 of the connector. Furthermore, the contacts 26 provide a more uniform current distribution than conventional single-beam contacts.

When the 56 or 58 terminals of a given column 1 or 2, respectively, are disposed longitudinally midway of the terminals of an adjacent column, whether of a common electrical contact (for instance, the same power contact 26) or of an adjacent electrical contact (such as a power contact 26), the spacing between the terminals can be maximized. Furthermore, it should be appreciated that the current levels traveling through the terminals can be adjusted by correspondingly adjusting the number of terminals disposed in each column 1 and 2. Any suitable number of terminals 56, 58 can be disposed along the columns 1 and 2 of the power contacts 26A-C as desired.

While the footprint 68 and its alternative embodiments have been illustrated and described with respect to the mounting terminals 36 of one or more adjacent AC power contacts 26, it should be appreciated that the footprint 68 can be defined by the mounting terminals of any type of contact, for instance single-beam AC power contacts, the signal contacts 24, or DC power contacts. While various embodiments have been described in combination with the electrical header connector 20, it should be appreciated that the various structures and features described herein can also be applicable to differently constructed header connectors, and can also be applicable to receptacle connectors, as will now be described with reference to FIGS. 4A-6.

As illustrated in FIGS. 4A-6, an electrical connector 120 is configured to mate with the electrical connector 20 described above. The electrical connector 120 includes an insulative or dielectric connector housing 122 and a plurality of electrical contacts 121, including a plurality of signal contacts 124 and power contacts 126, supported by the connector housing 122. The signal contacts 124 provide electrical connectivity for data transmission signals, while the power contacts 126 provide electrical connectivity for power transmission. The signal contacts 124 can be identically or substantially identically constructed, and the power contacts 126 can be identically or substantially identically constructed.

The signal contacts 124 can be constructed as pins, each including a body portion 128 having a mating end 130 at one end, and a mounting terminal 132 opposite the mating end 130. The mating ends 130 are configured to mate with the mating ends 30 of complementary signal contacts 24 of the electrical connector 20 that is to be mated with the electrical connector 120. In this regard, the connector housing 122 can include alignment features 123 configured to mate with corresponding alignment features of the complementary connector. The alignment feature 123 is illustrated as including a post that is configured to be inserted into the recess 23 of the electrical connector 20.

Figure 6:
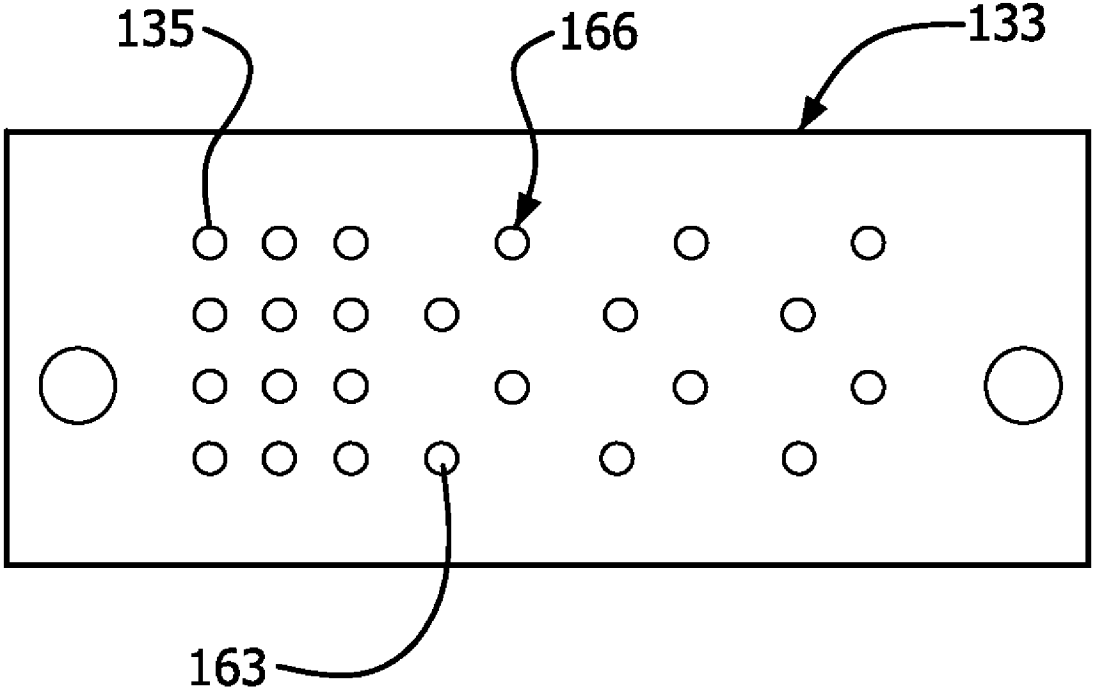
FIG. 6 is a schematic top plan view of a footprint of a printed circuit board onto which the electrical contacts of the connector illustrated in FIGS. 4A-B are configured to be mounted.

The mounting terminals 132 are configured to connect to a substrate 133, such as a printed circuit board 133 illustrated in FIG. 6. In one embodiment, the mounting terminals 132 are inserted through corresponding plated through-hole 135 of the printed circuit board 133. Alternatively, the mounting terminals 132 can be surface-mounted to the printed circuit board. The mounting terminals 132 can further be soldered to the printed circuit board 133 as desired. Thus, the signal contacts 124 can place the printed circuit board 133 in electrical communication with the complementary electrical connector 20, and thus the printed circuit board 33, when the electrical connectors 20 and 120 are mated. The signal contacts 124 are thus configured to transmit signal data between the printed circuit boards 33 and 133. As illustrated, the mating end 130 extends in a direction perpendicular to the mounting terminal 132, such that the signal contacts 124 can be referred to as right-angle contacts. Alternatively, the signal contacts 124 can be constructed as a "vertical" or "mezzanine" arrangement whereby the mating end 130 extends in a direction parallel to the mounting terminals 132.

Likewise, the power contacts 126 each define a mating end 134 at one end, and a mounting terminal 136 at an opposed end. The mating ends 134 are configured to mate with complementary mating ends, such as mating ends 34 of complementary power contacts 26 of the electrical connector 20 that is to be mated with the electrical connector 120. The mounting ends 136 are configured to connect to the printed circuit board 133. In one embodiment, the mounting ends 136 are inserted through respective plated through-holes 163 of the printed circuit board 133. The through-holes 163 can define mounting locations 166 that define a footprint constructed as described with respect to the footprint 68 described above with respect to FIG. 3B. Alternatively, the mounting terminals 136 can be surface-mounted to the printed circuit board. The mounting terminals 136 can further be soldered to the printed circuit board 133 as desired. Thus, the power contacts 126 can place the printed circuit board 133 in electrical communication with the complementary electrical connector 20, and thus the printed circuit board 33, when the electrical connectors 20 and 120 are mated. The power contacts 126 are thus configured to transmit signal data between the printed circuit boards 33 and 133.

As illustrated, the mating ends 134 extend in a direction perpendicular to the mounting terminals 136 such that the power contacts 126 can be referred to as right-angle contacts. Thus, the electrical connector 120 can be referred to as a right-angle connector. Alternatively, the power contacts 126 can be constructed as a "vertical" or "mezzanine" arrangement whereby the mating ends 134 extend in a direction parallel to the mounting terminals 136. Furthermore, because the mating ends 130 and 134 of the contacts 124 and 126, respectively, are configured to receive their complementary contacts, the signal contacts 124 and power contacts 126 can be referred to as "receptacle" contacts, and the electrical connector 120 can be referred to as a "receptacle" connector.

Figure 5A:
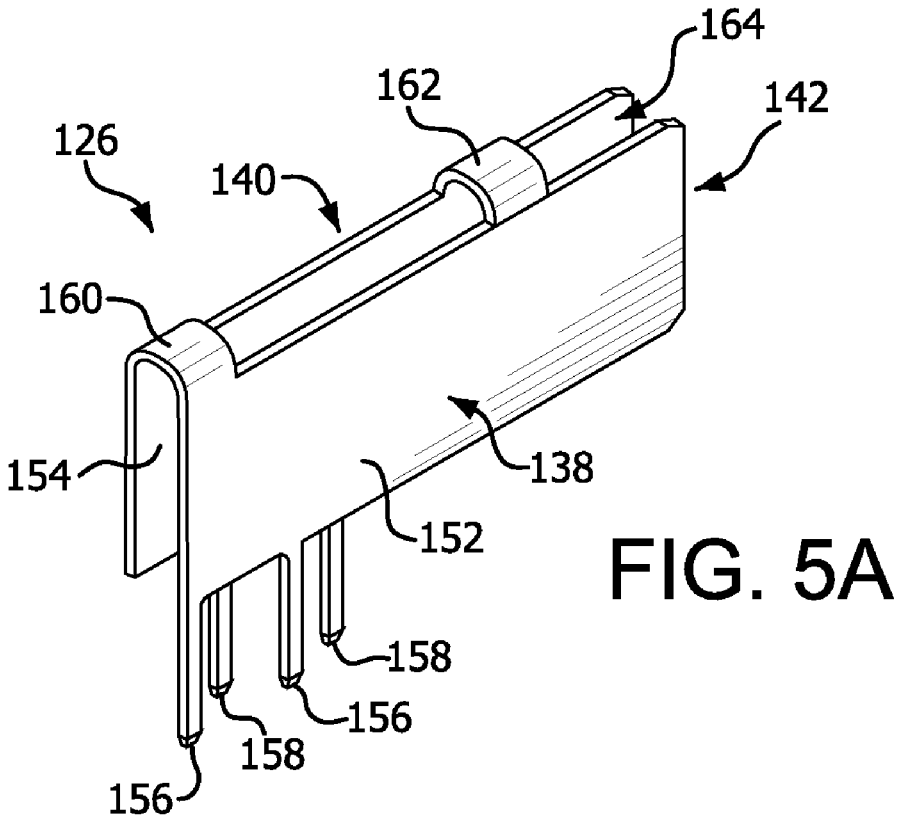
FIG. 5A is a perspective view of a power contact of the electrical receptacle connector illustrated in FIGS. 4A-B.
Figure 5B:
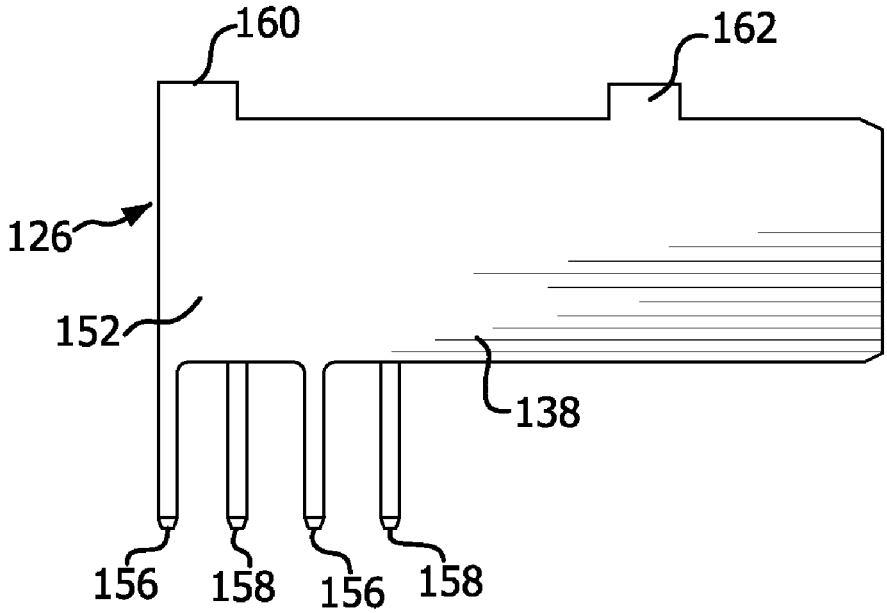
FIG. 5B is a side elevation view of the power contact illustrated in FIG. 5A.

As shown in FIGS. 5A-B, each of the receptacle power contacts 126 includes a pair of opposed, preferably planar and parallel, side walls major side walls 138 and 140. The side walls 138 and 140 extend forward in a front projecting portion 142 that forms a medial plug receiving space 164. The distance between the side walls 138 and 140 at front portion 142 is such that the projection 42 of the plug contact 26 is receivable in the plug contact receiving space 164, with the beams 44 being resiliently deflected toward the center plane of the contact 26. The deflection causes the beams 44 to develop outwardly directed forces, thereby pressing the arcuate contact sections 48 against the inner surfaces of the front portions 142 forming the receiving space 164, to develop suitable contact normal force. The side walls 138 and 140 also include respective panels 152 and 154. The side walls 138 and 140 are joined together by generally arcuate bridging elements 160 and 162. Preferably, the receptacle contact 126 is also stamped or otherwise formed in a single piece from a strip of phosphor bronze alloy, beryllium copper alloy, or other suitable electrically conductive material. The receptacle contacts 126 can be constructed as described in U.S. Pat. No. 6,319,075, the disclosure of which is hereby incorporated by reference as if set forth in its entirety herein.

The mounting terminal 136 of each power contact 126 includes a first at least one mounting terminal 156 (a pair of terminals 156 as illustrated) that extends down from an edge of the panel 152, and a second at least one mounting terminal 158 (a pair of mounting terminals 158 as illustrated) that extends down from an edge of the panel 154. The mounting terminals 156 and 158 can comprise through hole, solder-to-board pins (as shown), press fit pins or surface mount tails, or any alternatively constructed terminal as desired. The mounting terminals 156 are longitudinally offset with respect to the mounting terminals 158, and can thus define a footprint as described above with respect to the footprint 68 defined by the header contacts 26 illustrated in FIG. 3B. FIG. 6 illustrates the printed circuit board 133 as including a plurality of mounting locations 166, which can be provided as plated through holes in one embodiment that are configured to receive the mounting terminals 156 and 158 of the power contacts 126. The terminals can define a square or rectangular cross section, or any suitable cross-sectional shape as desired.

While various embodiments have been described in combination with the electrical header connector 20 and the electrical receptacle connector 120, it should be appreciated that the various structures features described herein can also be applicable to differently constructed header connectors. It should be appreciated that additional electrical connectors are described in U.S. Pat. No. 6,319,075, and that such connectors along with alternatively constructed connectors are suitable for incorporating the features associated with the mounting terminals as described herein.

Figure 7B:
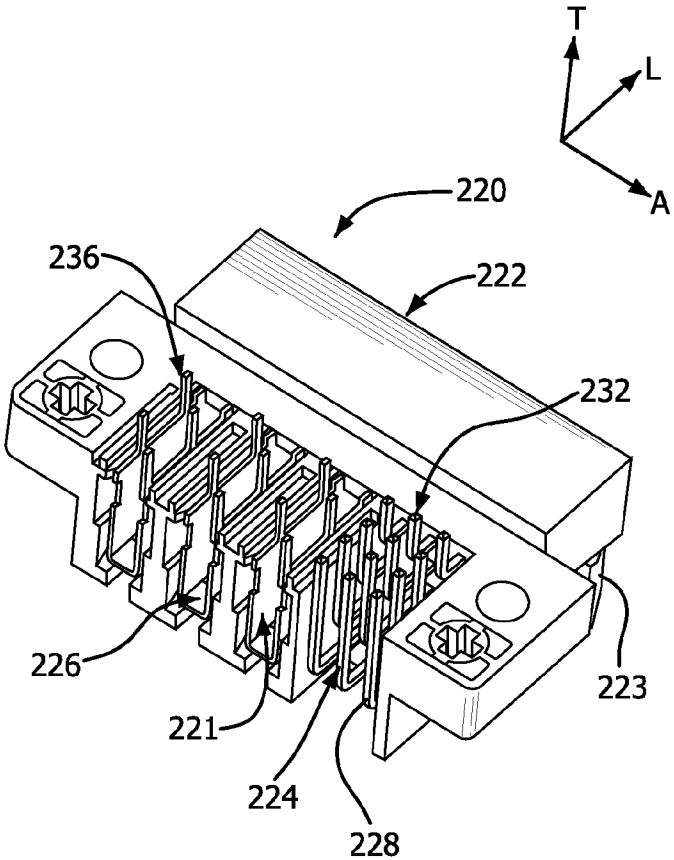
FIG. 7B is a bottom perspective view of the electrical header connector illustrated in FIG. 7A.
Figure 7A:
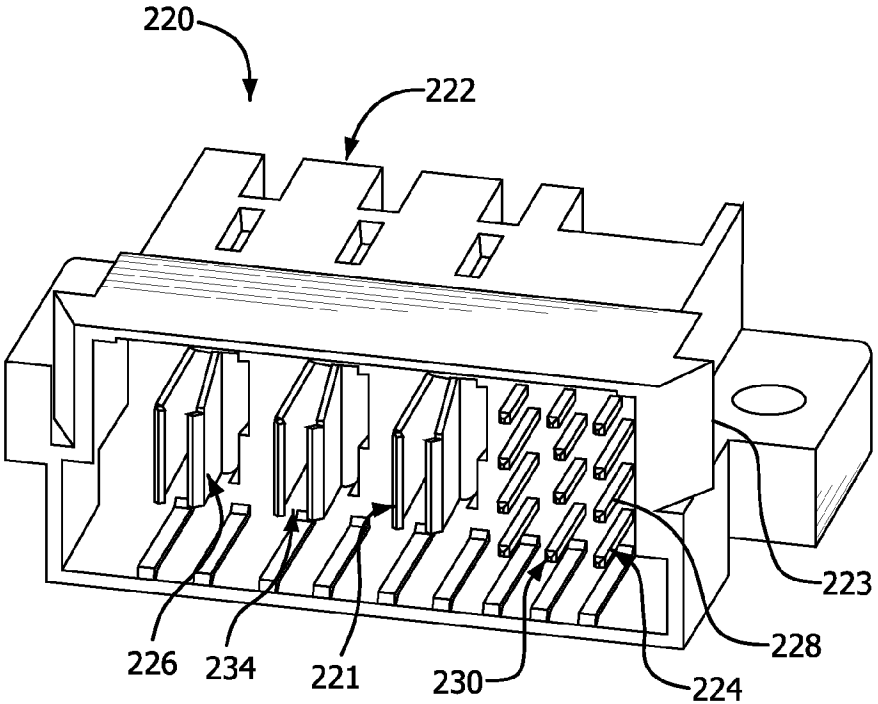
FIG. 7A is a front perspective view of an electrical header connector constructed in accordance with an alternative embodiment.
Figure 8:
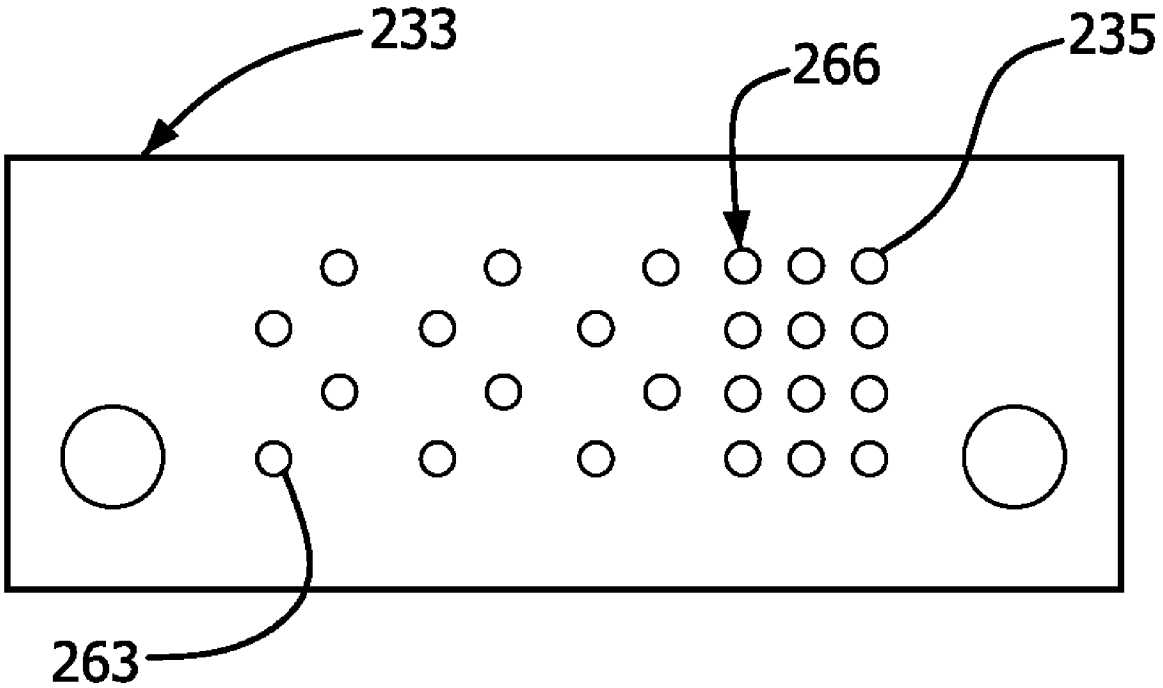
FIG. 8 is a schematic top plan view of a footprint of a printed circuit board onto which the electrical contacts of the connector illustrated in FIGS. 7A-B are configured to be mounted.
Figure 10A:
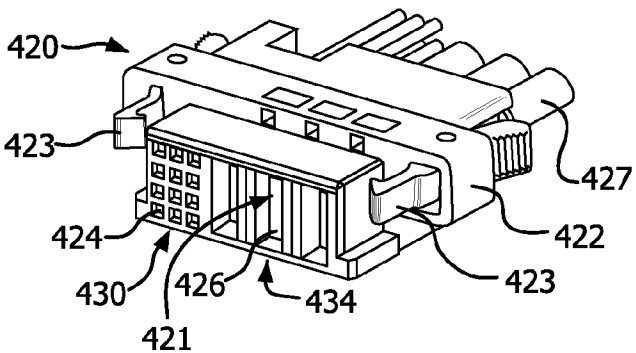
FIG. 10A is a perspective view of a cable receptacle connector configured in accordance with one embodiment.

Referring now to FIGS. 7A-8, a right-angle header connector 220 is constructed as described above with respect to the header connector 20. The reference numerals of connector 220 corresponding to like structure of the electrical connector 20 are incremented by 200 for the purposes of clarity. Thus, the header connector 220 includes a connector housing 222, and a plurality of electrical contacts 221, including a plurality of electrical signal contacts 224 and power contacts 226. The connector housing 222 includes alignment features 232 in the form of flared latch ears that can engage mating structure of the connector that is to be mated to the connector 222. An example of suitable mating structure is illustrated in FIG. 10A as squeezable latch arms 423. The signal contacts 224 can be constructed as pins, each including a body portion 228 having a mating end 230 at one end, and a mounting terminal 232 opposite the mating end. The power contacts 226 each define a mating end 234 at one end, and a mounting terminal 236 opposite the mating end 234. The mounting terminals 232 and 236 are configured to connect to a substrate such as a printed circuit board 233 at respective mounting locations 266, which can include plated though-holes 235 and 263, respectively. The mounting terminals 236 define a first plurality of mounting terminals 256 and a second plurality of mounting terminals 258 that are longitudinally offset from each other, and can thus define a footprint as described above with respect to the footprint 68 defined by the header contacts 26 illustrated in FIG. 3B.

Figure 9A:
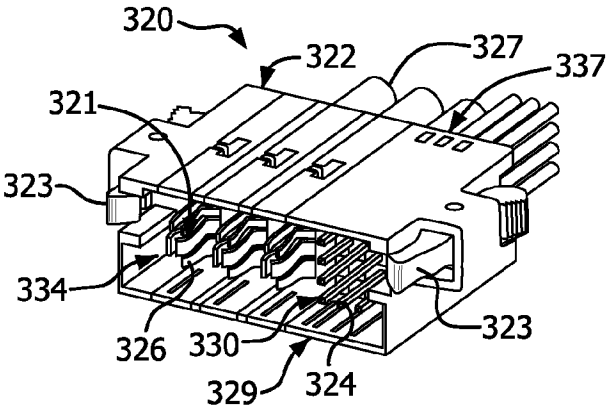
FIG. 9A is a perspective view of a cable header connector constructed in accordance with an alternative embodiment.
Figure 9B:
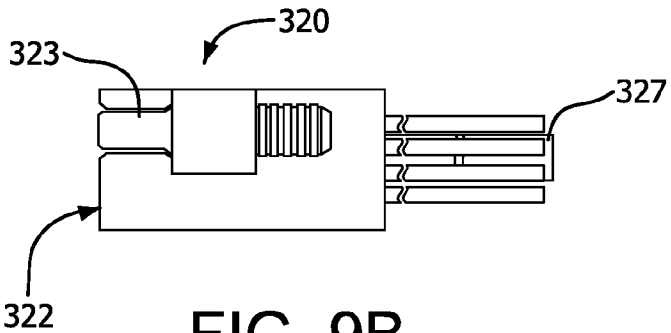
FIG. 9B is a side elevation view of the cable header connector illustrated in FIG. 9A.

Referring now to FIGS. 9A-B, an electrical connector 320 is illustrated including reference numerals corresponding to like structure of the electrical connector 20 incremented by 300 for the purposes of clarity. The electrical connector 320 is illustrated as a cable header connector having a housing 322 that includes alignment/retention features 323 in the form of squeezable latch arms that can releasably engage mating structure on a complementary connector that is to be mated to the connector 320. An example of suitable mating structure includes the latch ears of the type illustrated in FIG. 7A. Of course, the latch ears could be incorporated into a receptacle connector, for instance connector 520 illustrated in FIG. 11A, that is configured to be mated with the header connector 320.

The connector housing 322 retains a plurality of electrical contacts 321, including a plurality of signal contacts 324 and power contacts 336. The signal contacts 324 and power contacts 326 extend horizontally, such that the mating ends 330 of the signal contacts 324 are substantially parallel to the opposed mounting terminals, and the mating ends 334 of the power contacts 326 are substantially parallel to the opposed mounting terminals. The connector housing 322 further defines a mating interface 329 and a mounting interface 337 that is oriented substantially parallel to the mating interface 329. Thus, the contacts signal contacts 324, power contacts 326, and the electrical connector 320, can be referred to as vertical contacts, or a vertical connector 320. The power contacts 326 can connect at their mounting ends to a power cable 327, for instance in the manner described in U.S. Pat. No. 6,319,075. The cable 327 can be connected at its other end to any suitable electrical component. The mating ends of the signal contacts 324 and the power contacts 326 can be received inside the mating ends of a complimentary receptacle connector that is configured to be mated with the header connector 320. The mating receptacle connector can be constructed as described above with respect to the receptacle connector 120 or any alternatively constructed receptacle connector having, for instance, a footprint as described above with respect to the footprint 68 of the electrical connector 20.

Figure 10B:
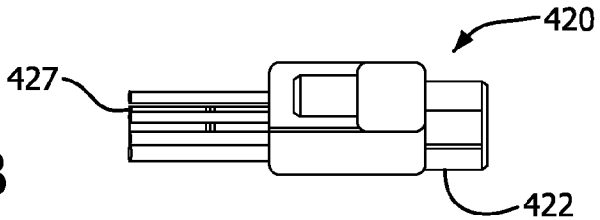
FIG. 10B is a side elevation view of the cable receptacle connector illustrated in FIG. 10A.

Referring now to FIGS. 10A-B, a receptacle connector 420 is illustrated including reference numerals corresponding to like structure of the electrical connector 20 incremented by 400. The connector 420 is illustrated as a cable connector having a connector housing 422 that retains a plurality of electrical contacts 421, including a plurality of signal contacts 424 and a plurality of power contacts 436. The connector housing 422 includes alignment/retention features 423 in the form of squeezable latch arms that can releasably engage mating structure on a complementary connector that is to be mated to the connector 420. An example of suitable mating structure includes the latch ears of the type illustrated in FIG. 7A. Of course, the latch ears could be incorporated into a receptacle connector that is configured to be mated with the header connector 320.

The signal contacts 424 and power contacts 426 extend horizontally, such that their mating ends are parallel with their mounting ends. Similarly, the mating end of the connector housing 422 is oriented substantially parallel to the mounting end. Thus, the contacts 424 and 426, and the connector 420, can be referred to as vertical contacts, or a vertical connector 420 respectively. The power contacts 426 can connect at their mounting ends to a power cable 427, for instance in the manner described in U.S. Pat. No. 6,319,075. The cable 427 can be the same cable as cable 327, thereby electrically coupling the connectors 320 and 420, or the cable 427 can be different from the cable 327 and can connect to any suitable electrical device. The mating ends of the contacts 424 and 426 can receive the mating ends of a complimentary header connector that is configured to be mated with the header connector 420. The housing 422 can further include a shroud 430 that surrounds and protects the mating ends of the contacts 424 and 426. The mating header connector can be constructed as described above with respect to the header connector 20, connector 220, or any suitable alternatively constructed header connector having a footprint as described with respect to the footprint 68 of the electrical connector 20.

Therefore, it should be appreciated that an electrical header or receptacle connector defining a footprint at its mounting interface as described above with respect to the footprint 68 of the electrical connector 20 can alternatively be configured to connect to a cable connector. The cable connector and/or mating connector can be a right-angle, or a vertical or mezzanine connector as desired.

Figure 11B:
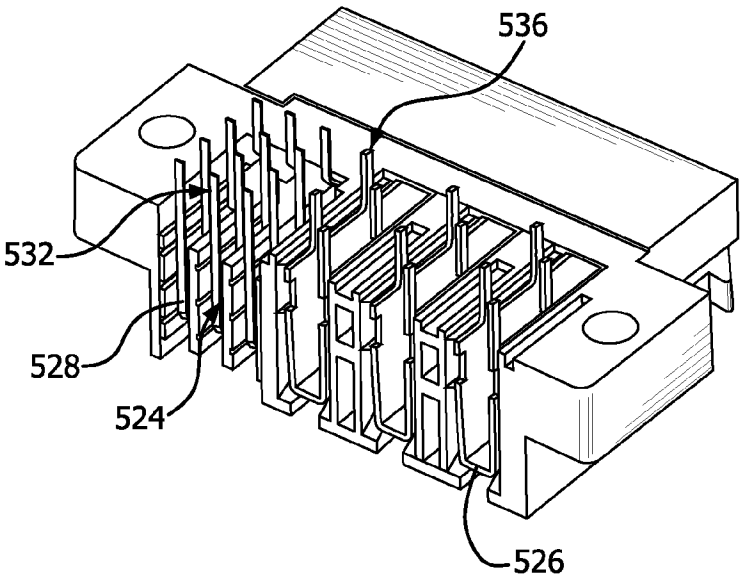
FIG. 11B is a bottom perspective view of the electrical receptacle connector illustrated in FIG. 11A.
Figure 11A:
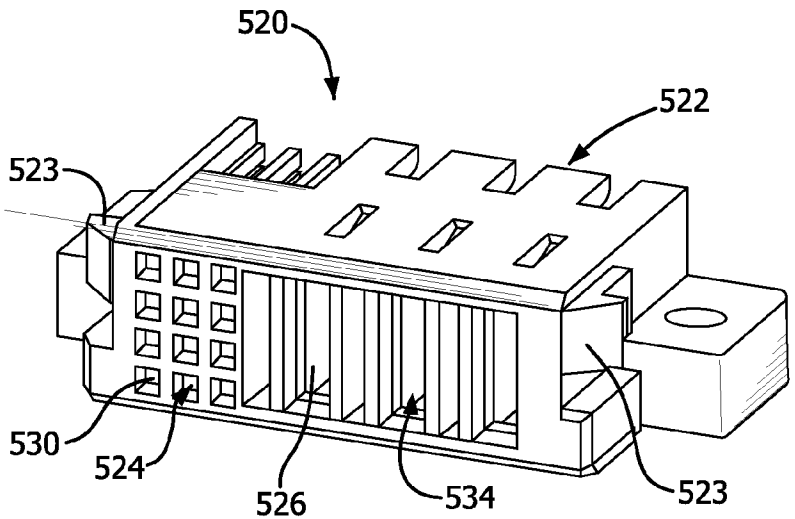
FIG. 11A is a front perspective view of an electrical receptacle connector configured to mate with the cable header connector illustrated in FIGS. 9A-B.
Figure 12:
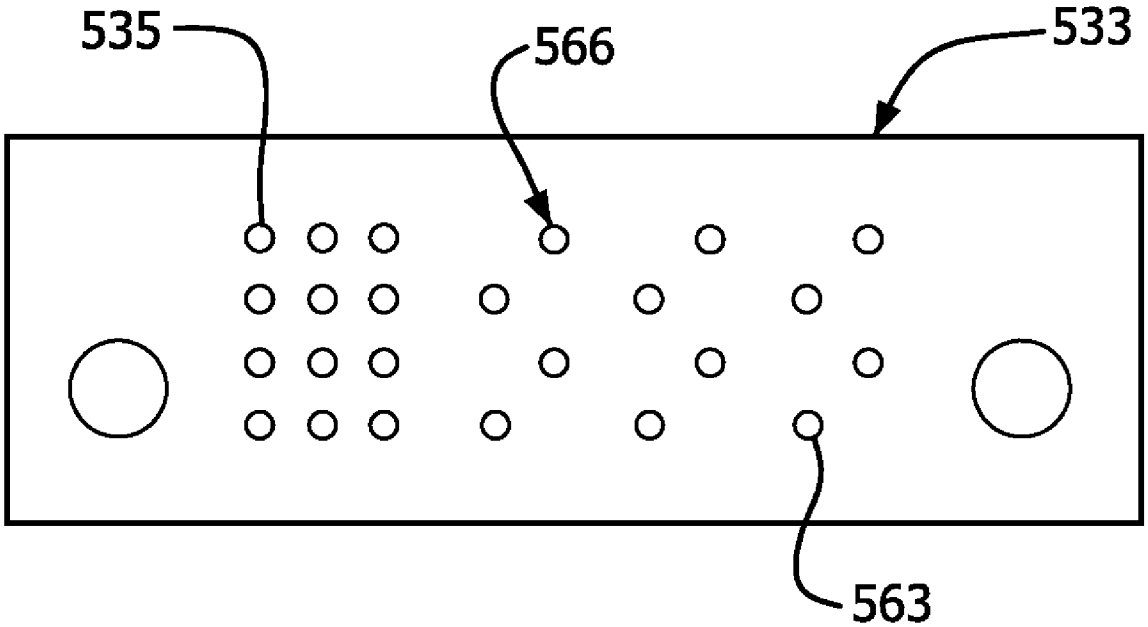
FIG. 12 is a schematic top plan view of a footprint of a printed circuit board configured onto which the electrical contacts of the cable receptacle connector illustrated in FIGS. 11A-B are configured to be mounted.

Referring now to FIGS. 11A-12, an electrical receptacle connector 520 is configured to mate with a header connector, such as the header connector 320 described above. The connector 520 is illustrated having reference numerals corresponding to like structure of the receptacle connector 120 incremented by 400 for the purposes of clarity. The connector 520 is constructed as described above with respect to the electrical connector 120, however the alignment/retention features are provided as latch ears configured to engage complementary structure of an electrical connector that is to be mated to the connector 520. For instance, the latch ears can engage latch arms of the type described above with reference to the connector 320 illustrated in FIG. 9A.

Figure 13A:
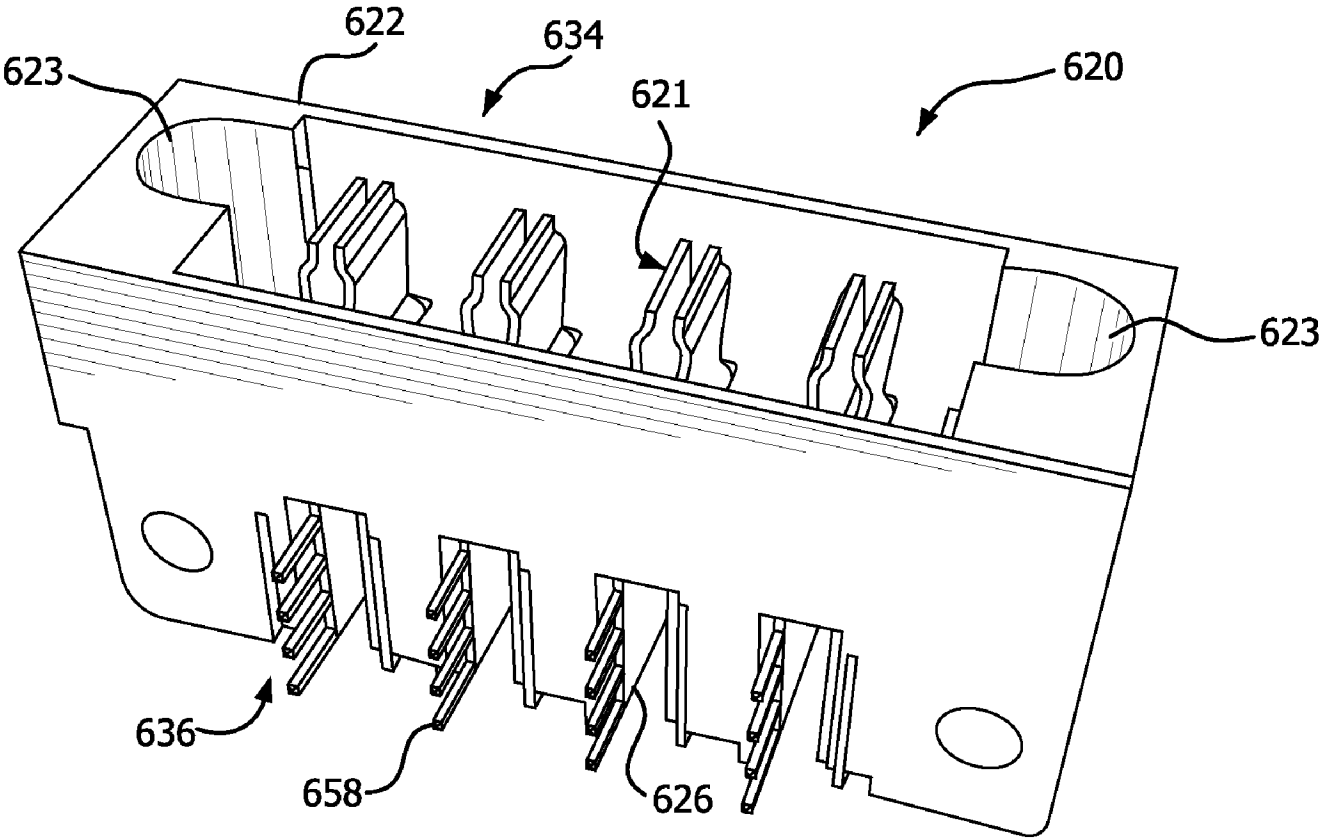
FIG. 13A is a perspective view of an electrical header connector constructed in accordance with another alternative embodiment.
Figure 13B:
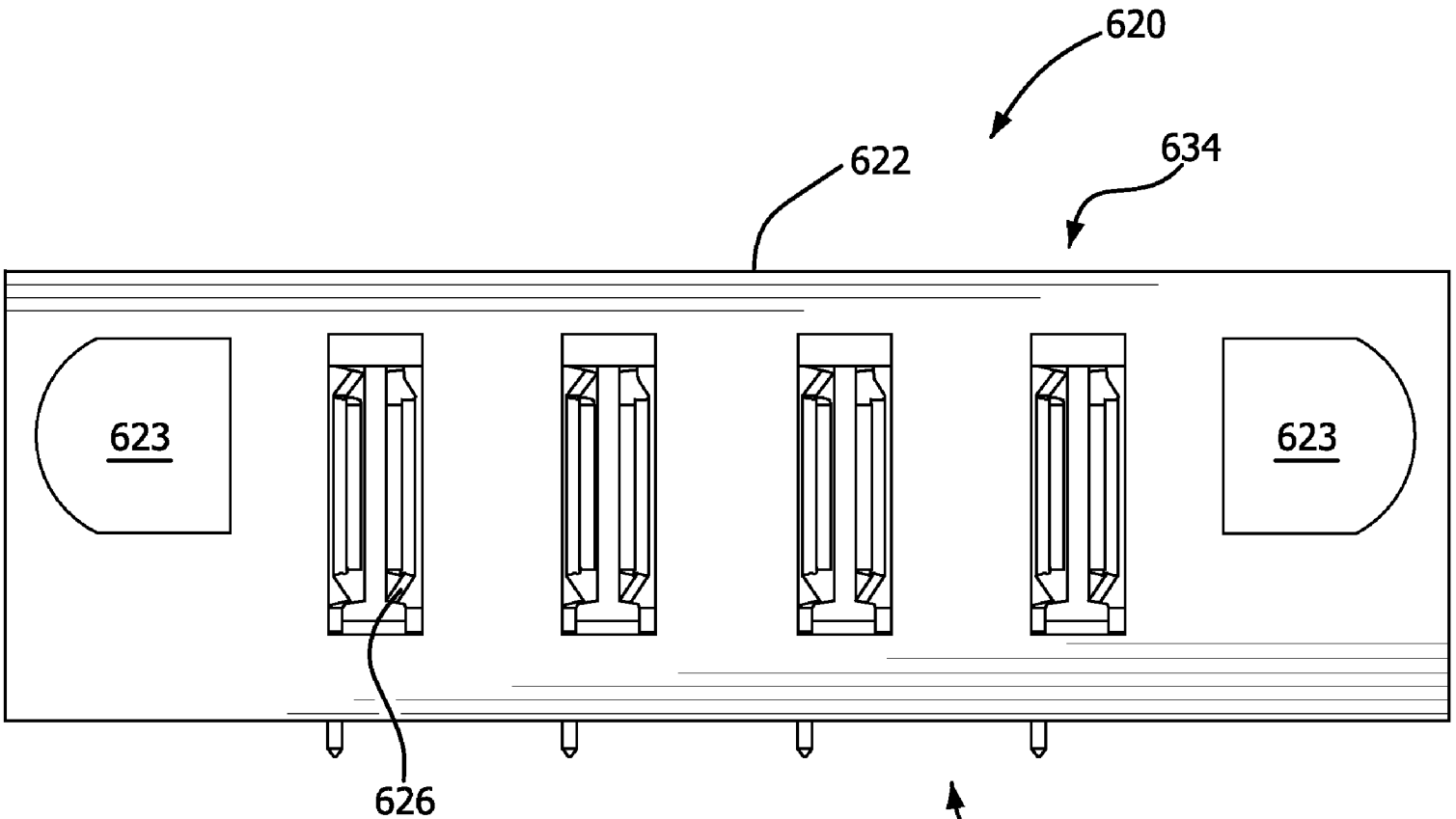
FIG. 13B is a front elevation view of the connector illustrated in FIG. 13A.
Figure 13C:
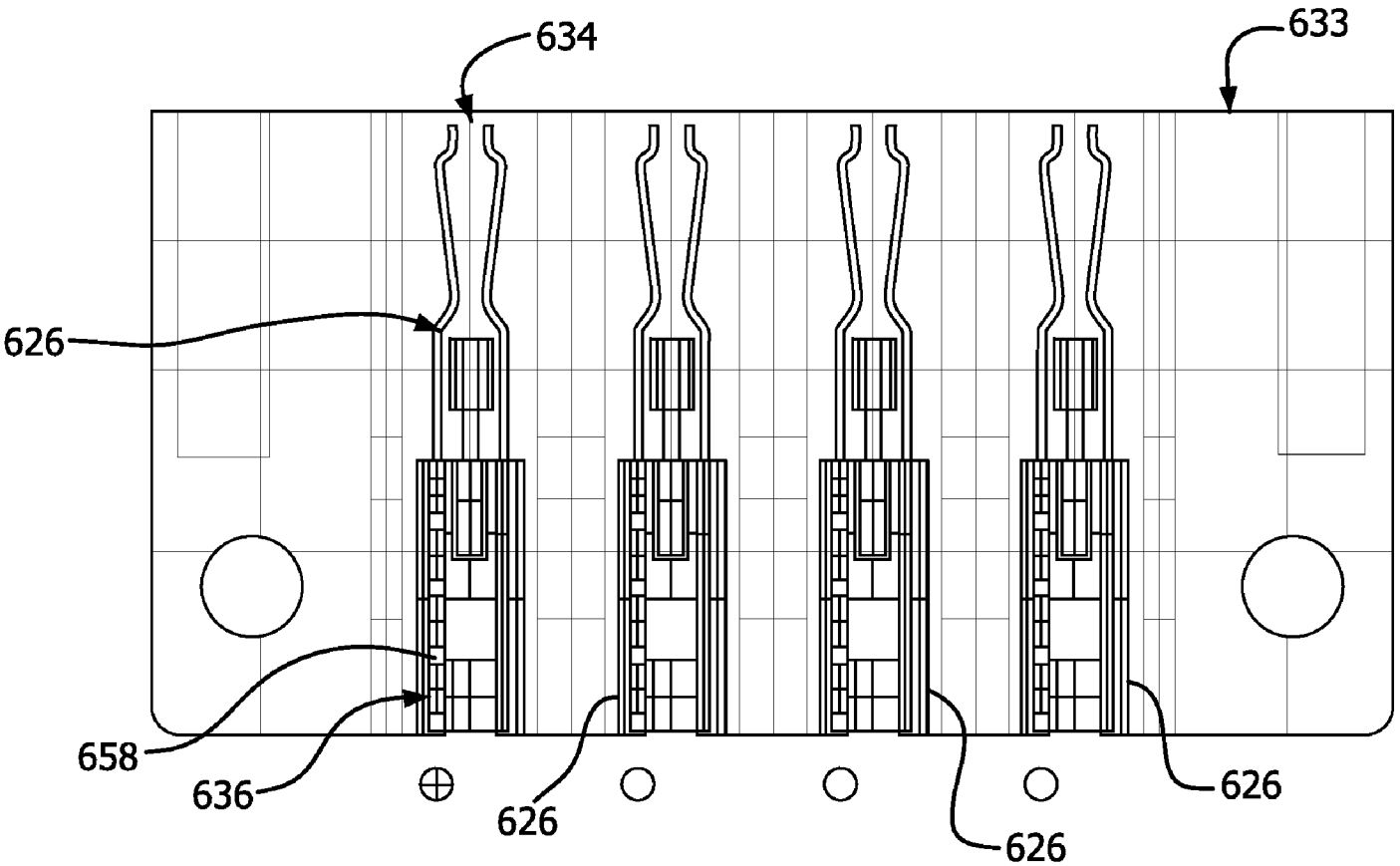
FIG. 13C is a schematic bottom plan view showing a footprint of the electrical connector illustrated in FIG. 13A relative to a substrate onto which the electrical contacts of the electrical connector are configured to be mounted.

Referring to FIGS. 13A-C, and as described above, the mounting ends of the signal and power contacts of any of the electrical connectors described above can be constructed in accordance with alternative embodiments. For instance, a header connector 620 is illustrated having reference numerals corresponding to like elements of the electrical connector 20 incremented by 600 for the purposes of clarity. As illustrated, the connector housing 622 supports a plurality of electrical contacts 621 including a plurality of power contacts 626, though the electrical connector 620 could alternatively or additionally include signal contacts. The power contacts 626 are configured to transmit AC power or DC power, though the housing could alternatively include dedicated AC power contacts and dedicated DC power contacts if desired.

Figure 13D:
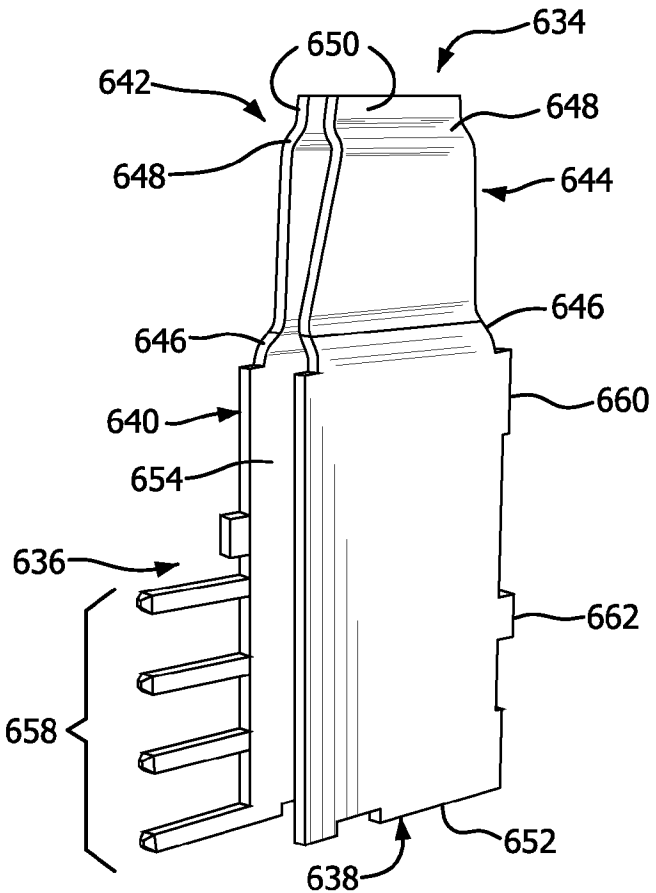
FIG. 13D is a perspective view of one of the electrical contacts of the connector illustrated in FIG. 13A.

As shown in FIG. 13D, each of the power contacts 626 can be constructed as described above with respect to the power contact 26, however the mounting terminal 636 of each power contact 626 include only one plurality of mounting terminals that extend down from only one of the side walls 638 and 640. In the illustrated embodiment, the power contacts 626 each include a plurality of mounting terminals 658 that extend down from the panel 654, such that the panel 652 is devoid of mounting terminals, though the arrangement could be reversed if desired such that mounting terminals extend down from the panel 652 and not panel 654. Thus, each power contact 626 defines a pair of spaced side walls in the form of laterally spaced panels 652 and 654, but only a single column of mounting terminals. Otherwise stated, each power contact defines fewer columns of mounting terminals than spaced side walls. The power contact 626 is illustrated as including four mounting terminals 658 spaced along the panel 654, though any number of mounting terminals 658 can be provided. It should be appreciated that the mounting ends of one or more, up to all, of the contacts of any of the connectors described herein can be constructed as illustrated and described herein with respect to the connector 620.

It should be appreciated in alternative constructions that the power contacts 626, and any other contacts such as signal contacts, could be constructed with any number of side walls, including one or more sidewalls, that define one or more columns of mounting terminals as described herein. Alternatively, the contacts can be provided as individual pins or any alternative structure as desired that define mounting terminals as described herein.

While an increased distance between adjacent mounting terminals reduces the chances that current will arc across the terminals during operation, it should be appreciated that other types of contacts may benefit from provided an increased distance between the mounting terminals, or at any other location along the length of the contacts. Thus, the mounting terminals of signal contacts, for instance, may be spaced apart as described herein. While an increased distance between mounting tails has been described herein in accordance with a staggered terminal architecture, it should be appreciated that the mounting terminals 658 need not be staggered to increase the distance between terminals of adjacent columns with respect to conventional connectors that are constructed with mounting terminals 658 extending from both side walls 638 and 640.

Figures 14A, 14B:
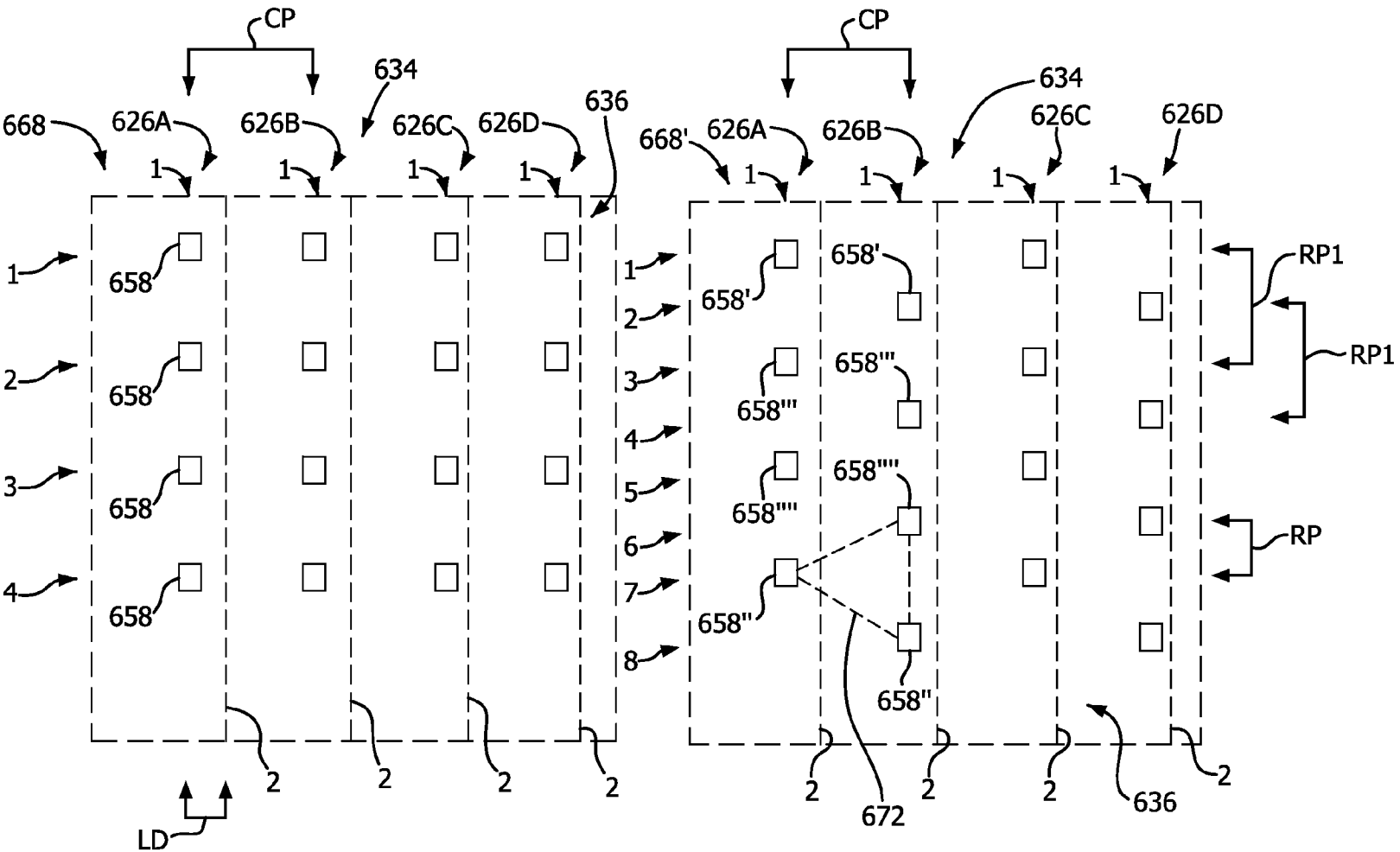
FIG. 14A is a schematic view of a footprint defined by mounting terminals of the connector illustrated in FIG. 13A in accordance with one embodiment.
FIG. 14B is a schematic view of a footprint defined by mounting terminals of the connector illustrated in FIG. 13A in accordance with another embodiment.

For instance, FIG. 14A illustrates a schematic view of a footprint 668 defined by the mounting end 636 of four power contacts 626A-D of the electrical connector 620 from a bottom plan view of the connector 620, though the electrical connector 620 can include any number of contacts 626 as desired. It can be seen that all terminals 658 are disposed along a single column 1, and that a second column that would otherwise have been defined by the other side wall 638 is devoid of contacts. Therefore, the column pitch CP between adjacent columns of contacts is increased by the lateral distance LD between the side walls 638 and 640 relative to a conventional connector having terminals extending from the side wall 638 that are not staggered with respect to the terminals extending from the side wall 640. In this regard, the side walls 638 that are devoid of terminals may be referred to as spacer walls in that they further space the terminals of adjacent contacts from each other. In FIG. 14A, the terminals 658 of adjacent contacts 626 are disposed along common laterally extending rows 1-4.

While the connector 620 can define the footprint 668 as described above, it should be further appreciated that the mounting terminals 658 can further be longitudinally staggered in the manner described above, for instance with respect to the first and second plurality of mounting terminals 56 and 58 of the electrical connector 20. FIG. 14B illustrates a footprint 668' that can be defined when adjacent power contacts 626 define a plurality of mounting terminals 658 that are longitudinally staggered with respect to the mounting terminals 658 of adjacent power contacts 626.

In particular, the mounting terminals 658 of each power contact 626 are arranged in a first column (column 1) of the respective contact, while the second column (column 2) is devoid of mounting terminals as described above with reference to FIG. 14A. It can thus be said that the mounting terminals 658 are arranged in at least one column, which can for instance include be column 1 as illustrated in FIG. 14B, or can include columns 1 and 2 as described above with respect to FIG. 3B. Each column 1 of terminals 658 defined by a given power contact 626 includes a select terminal that is longitudinally offset with respect to all adjacent terminals disposed along an immediately adjacent column of an immediately adjacent contact. Thus, the select mounting terminal can be said to be disposed longitudinally between adjacent terminals disposed along an immediately adjacent column of an immediately adjacent contact. The adjacent column is thus devoid of a mounting terminal that is in lateral alignment with the select mounting terminal. For instance, each power contact 626 defines a first or upper terminal 658', a second or lower terminal 658", a third terminal 658''' disposed below the upper terminal 658', and a fourth terminal 658'''' disposed below the third terminal 658''' and above the second terminal 658". The lower terminal 658" of the power contact 626A is disposed longitudinally between the two lowermost terminals 658'''' and 658" of the column 1 of the immediately adjacent contact 626B.

It should be appreciated that no terminals are disposed between the terminals 658 of contact 626B along column 1 between which the lower terminal 658 of contact 626A is disposed. Otherwise stated, no terminals are disposed between rows 6 and 8 along column 1 of contact 626B. Because the lower terminal 658" of contact 26A is disposed longitudinally midway between the adjacent terminals 658"" and 658" of contact 26B, the terminals 658 define an isosceles triangle 672. The angles defined by the vertices of the triangle 672 can be dependent on the row pitch RP of the terminals and also on the column pitch CP. It should be appreciated that while terminals of one column are illustrated as being disposed longitudinally midway between the terminals of an adjacent column of the adjacent connector, the terminals can be offset by any longitudinal distance as desired.

With continuing reference to FIGS. 13A-D and 14B, a first electrical contact 626A and a second electrical contact 626B each define a mating end and an opposed plurality of mounting terminals 658. Each of the first and second electrical contacts 626A and 626B defines first and second longitudinally elongate side walls that are laterally spaced from each other, such that the second side wall of the first electrical contact 626A is disposed adjacent the first side wall of the second electrical contact 626B. Each of the first and second side walls of each of the first and second electrical contacts 626A and 626B extend along respective first and second columns, such that the mounting terminals 658 of the first and second electrical contacts 626A and 626B are arranged in respective the first columns 1 and not the respective second columns. The mounting terminals 658 of the first electrical contact 626A are longitudinally staggered with respect to the mounting terminals 658 of the second electrical contact 626B.

A select one of the mounting terminals of the first electrical contact 626 (e.g., mounting terminal 658") is disposed substantially longitudinally midway between a pair of adjacent mounting terminals (e.g., mounting terminals 658" and 658"") of the second electrical contact 626B.

Thus, the terminals 658 of adjacent contact 626 can be further spaced apart with respect to the terminals 658. It should be appreciated that a connector can be in compliance with Underwriters Laboratories (UL) Standard 60950 when constructed as described with reference to at least the connector 620.

It should be noted that the illustrations and discussions of the embodiments shown in the figures are for exemplary purposes only, and should not be construed limiting the disclosure. One skilled in the art will appreciate that the present disclosure contemplates various embodiments. It should be further appreciated that the features and structures described and illustrated in accordance one embodiment can apply to all embodiments as described herein, unless otherwise indicated. Additionally, it should be understood that the concepts described above with the above-described embodiments may be employed alone or in combination with any of the other embodiments described above.

What is claimed:

1. A method to reduce arcing between mounting terminals of power contacts, the method comprising the steps of:

identifying a first electrical contact that defines a mating end and an opposed plurality of mounting terminals that are arranged in first and second columns that are elongate in a longitudinal direction and are disposed laterally adjacent to each other, such that no mounting terminals are disposed laterally between the first and second adjacent columns of the first electrical contact;

identifying a second electrical contact that defines a mating end and an opposed plurality of mounting terminals that are arranged in first and second columns that are elongate in a longitudinal direction and are disposed laterally adjacent to each other, such that no mounting terminals are disposed laterally between the first and second adjacent columns of the second electrical contact, wherein when the first and second electrical contacts are supported by an electrically insulative connector housing, a select mounting terminal of a select one of the first columns of the first and second electrical contacts is aligned in the lateral direction with at least one of the mounting terminals of the other of the first and second electrical contacts; and eliminating at least one of the mounting terminals of at least one of the second columns such that the select mounting terminal is longitudinally offset with respect to all mounting terminals of the at least one of the second columns when the first and second electrical contacts are supported by the connector housing.

2. The method as recited in claim 1, further comprising the step of supporting the first and second electrical contacts in the connector housing such that the second column of the first electrical contact is disposed laterally adjacent the first column of the second electrical contact, whereby no mounting terminals are disposed laterally between the second column of the first electrical contact and the first column of the second electrical contact.

3. The method as recited in claim 2, further comprising the step of placing the second column of the first electrical contact closer to the first column of the first electrical contact than to the first column of the second electrical contact.

4. The method as recited in claim 1, wherein each of the first and second electrical contacts comprises first and second laterally spaced side walls, the method comprising the step of extending a first plurality of the mounting terminals from the first side wall, and extending a second plurality of the mounting terminals from the second side wall.

5. The method as recited in claim 1, further comprising the step of disposing the select mounting terminal longitudinally between a pair of mounting terminals of the at least one of the second columns.

6. The method as recited in claim 5, wherein the select one of the first columns and the at least one of the second columns are of the first electrical contact.

7. The method as recited in claim 5, wherein the select one of the first columns and the at least one of the second columns are of the second and first electrical contact, respectively.

8. The method as recited in claim 5, further comprising the step of disposing the select mounting terminal substantially longitudinally midway between the pair of mounting terminals.

9. The method as recited in claim 5, further comprising the step of disposing no additional mounting terminals longitudinally between the pair of mounting terminals.

10. The method as recited in claim 1, wherein the first and second electrical contacts comprises a plurality of power contacts.

11. A method of constructing an electrical power connector, the method comprising the steps of:

constructing a first electrical contact that defines a mating end and an opposed plurality of mounting terminals that are arranged in first and second columns that are elongate in a longitudinal direction and are disposed laterally adjacent to each other, such that no mounting terminals are disposed laterally between the first and second adjacent columns of the first electrical contact; and constructing a second electrical contact that defines a mating end and an opposed plurality of mounting terminals that are arranged in first and second columns that are elongate in a longitudinal direction and are disposed laterally adjacent to each other, such that no mounting terminals are disposed laterally between the first and second adjacent columns of the second electrical contact, such that when the first and second electrical contacts are supported by a connector housing, a select mounting terminal of a select one of the first columns of the first and second electrical contacts is longitudinally offset with respect to all mounting terminals of the at least one of the second columns.

12. The method as recited in claim 11, further comprising the step of supporting the first and second electrical contacts in the connector housing such that the second column of the first electrical contact is disposed laterally adjacent the first column of the second electrical contact, whereby no mounting terminals are disposed laterally between the second column of the first electrical contact and the first column of the second electrical contact.

13. The method as recited in claim 12, further comprising the step of placing the second column of the first electrical contact closer to the first column of the first electrical contact than to the first column of the second electrical contact.

14. The method as recited in claim 11, wherein 1) the first constructing step further comprises defining first and second laterally spaced side walls of the first electrical contact, and extending a first plurality of the mounting terminals from the first side wall, and extending a second plurality of the mounting terminals from the second side wall, and 2) the second constructing step further comprises defining first and second laterally spaced side walls of the second electrical contact, and extending a second plurality of the mounting terminals from the first side wall of the second electrical contact, and extending a second plurality of the mounting terminals from the second side wall of the second electrical contact.

15. The method as recited in claim 11, further comprising the step of disposing the select mounting terminal longitudinally between a pair of mounting terminals of the at least one of the second columns.

16. The method as recited in claim 15, wherein the select one of the first columns and the at least one of the second columns are of the first electrical contact.

17. The method as recited in claim 15, wherein the select one of the first columns and the at least one of the second columns are of the second and first electrical contact, respectively.

18. The method as recited in claim 15, further comprising the step of disposing no additional mounting terminals longitudinally between the pair of mounting terminals.

19. The method as recited in claim 11, wherein the first and second electrical contacts comprises a plurality of power contacts.

20. A method of constructing an electrical power connector, the method comprising the steps of:

supporting first and second electrical contacts in an electrically insulative connector housing, each electrical contact defining a mating end and an opposed plurality of mounting terminals, such that (i) each of the first and second electrical contacts defines first and second longitudinally elongate side walls that are laterally spaced from each other, such that the second side wall of the first electrical contact is disposed adjacent the first side wall of the second electrical contact, (ii) each of the first and second side walls of each of the first and second electrical contacts extend along respective first and second columns, (iii) the mounting terminals of the first and second electrical contacts are arranged in respective the first columns and not the respective second columns, and (iv) the mounting terminals of the first electrical contact are longitudinally staggered with respect to the mounting terminals of the second electrical contact.

21. The method as recited in claim 20, wherein the supporting step further includes disposing a select one of the mounting terminals of the first electrical contact substantially longitudinally midway disposed between a pair of adjacent mounting terminals of the second electrical contact.

22. The method as recited in claim 20, wherein the first and second electrical contacts comprise power contacts.

23. The method as recited in claim 20, wherein the supporting step ensures that no mounting terminals are disposed laterally between the first columns of the first and second electrical contacts.

* * * * *